US009487938B2

(12) United States Patent
Li et al.

(10) Patent No.: US 9,487,938 B2
(45) Date of Patent: Nov. 8, 2016

(54) AUTOMATIC PROTECTION DEVICE FOR A TOILET INLET VALVE OR DRAIN VALVE

(71) Applicant: Feiyu Li, Xiamen (CN)

(72) Inventors: Xiping Li, Xiamen (CN); Yuzhi Liu, Xiamen (CN); Dongsheng Yao, Xiamen (CN); Baojia Huang, Xiamen (CN); Wenqing Xie, Xiamen (CN); Jianfu Wu, Xiamen (CN)

(73) Assignee: WDI (XIAMEN) TECHNOLOGY INC., Xiamen (CN)

( * ) Notice: Subject to any disclaimer, the term of this patent is extended or adjusted under 35 U.S.C. 154(b) by 216 days.

(21) Appl. No.: 14/197,742

(22) Filed: Mar. 5, 2014

(65) Prior Publication Data

US 2015/0083238 A1 Mar. 26, 2015

(30) Foreign Application Priority Data

Sep. 25, 2013 (CN) ..... 2013 2 0594738 U

(51) Int. Cl.
*E03D 1/32* (2006.01)

(52) U.S. Cl.
CPC ..... *E03D 1/32* (2013.01); *Y10T 137/7287* (2015.04)

(58) Field of Classification Search
CPC ..... E02D 1/32; Y10T 137/7287; Y10T 137/7313; Y10T 137/7323
USPC ..... 137/386, 430, 426, 420, 421, 613; 4/435, 427, 240, 421
See application file for complete search history.

(56) References Cited

U.S. PATENT DOCUMENTS

| | | | | |
|---|---|---|---|---|
| 7,419,589 | B2 * | 9/2008 | Eserkaln | C02F 1/688 137/268 |
| 8,209,792 | B1 * | 7/2012 | Quintana | E03D 1/00 4/420 |
| 2012/0211094 | A1 * | 8/2012 | Quintana | F16K 3/08 137/386 |

* cited by examiner

*Primary Examiner* — Jessica Cahill
*Assistant Examiner* — Daphne M Barry
(74) *Attorney, Agent, or Firm* — Rabin & Berdo, P.C.

(57) ABSTRACT

An automatic protection device for an inlet valve or drain valve includes an inlet, an outlet, an on-off component, a control circuit, a control component, a water level inductor of the water tank and a water level inductor of the toilet. The water level inductor of the water tank and the water level inductor of the toilet are respectively connected to the control circuit, the control circuit drives the control component, the control component is connected to the on-off component to control the on-off component to open or close, thus connecting or disconnecting the inlet and the outlet. The automatic protection device will sound an alarm and automatically cut off the water supply when the drain valve fails to discharge, or when the toilet is plugged up and is unable to drain water.

14 Claims, 31 Drawing Sheets

AUTOMATIC PROTECTION DEVICE FOR A TOILET INLET VALVE OR DRAIN VALVE

FIELD OF THE INVENTION

The present invention relates to a toilet detect device, especially to an automatic protect device when the inlet valve or the drain valve is failed or when the toilet is plugged up.

BACKGROUND OF THE INVENTION

A Chinese utility model with patent number 201120264745.0 discloses a water tank inlet valve, which comprises a valve body, a water seal cover, a valve cover, a lever and a float, the valve cover is connected to the valve body and from a valve cavity, the valve body is disposed with a water inlet pipe connected to the valve cavity, the water seal cover is disposed inside the valve cavity, the bottom of the water seal cover is connected to the lever, the lever is connected to the float by an adjusting screw, the water seal cover seals or opens the opening of the water inlet pipe of the valve body under the work of the lever, the top surface of the water seal cover is disposed with a lock element, the lock element is disposed with a boss, a groove is disposed on the top surface and the boss; the top surface of the water seal cover is disposed with a silicone pad, which is sleeved on the lock element; when water flows in through the groove of the boss of the water seal cover, as the silicone pad is thin, under the water stress, the inclined surface between the silicone pad and the water seal cover will be impacted and open a clearance for inlet, the float rises under the work of floatage, it takes the pressure lever to close the small hole of the valve cover, when pressure is large enough to drive the water seal cover to make the silicone pad pressed tightly on the valve body, the inlet valve stops inflowing, meanwhile the dirt and silt are taken away, thus preventing being blocked or a failure of the inlet valve.

Above utility model achieves to close the inlet valve by using the water pressure, however, if it is applied in a toilet water tank that is not sealed, in which water pressure doesn't float much, above utility model will not work, then if the inlet valve is failed, water continuously flows out.

SUMMARY OF THE INVENTION

The object of the present invention is to overcome the disadvantage of the existing technology and provide an automatic protect device to solve the problems that when the inlet valve is failed to close the waterway, the drain valve is failed and leaks water, or when the toilet is plugged up.

The technical proposal of the present invention is as below:

An automatic protect device when the inlet valve or the drain valve is failed or when the toilet is plugged up comprising an inlet, an outlet, an on-off component, a control circuit, a control component, a water level inductor of the water tank and a water level inductor of the toilet, the water level inductor of the water tank and the water level inductor of the toilet are respectively connected to the control circuit, the control circuit drives the control component, the control component is connected to the on-off component to control the on-off component to open or close, thus implementing the connection or the disconnection of the inlet and the outlet, thereinto, the inlet, the outlet, the on-off component, the control circuit and the control component compose a main controller, the main controller is assembled between the water resource pipe and the inlet end of the inlet valve.

In another preferred embodiment, the on-off component comprising a moving plate and a fixed plate, the fixed plate is disposed with a water hole, the moving plate is closely contacted to the fixed plate, the moving plate moves with respect to the fixed plate, so that the water hole is open or closed, thus implementing the open or close of the water flowing.

In another preferred embodiment, the control component comprising a gear shaft, a rack, a slide shaft and a connecting element of the rack, the gear shaft is engaged with the rack, one end of the slide shaft is sercured to the rack, the other end of the slide shaft is secured to the connecting element of the rack, the moving plate is fixed to the connecting element of the rack; the gear shaft, when rotating, drives the rack to move, thus driving the slide shaft to drive the connecting element of the rack to move, thus driving the moving plate to move with respect to the fixed plate.

In another preferred embodiment, the control component further comprising a crank, a solenoid, a knob and a main spring, the gear shaft passes through the crank to connect to the knob, the gear shaft, the crank and the knob form a linkage connection, the main spring abuts against the rack and pushes the rack, thus forming a trend to drive the on-off component to close; the crank is disposed with a crank hole, when the on-off component is open, the solenoid is locked inside the crank hole.

In another preferred embodiment, a pressing element abuts against the moving plate in the front, the pressing element pushes the moving plate by a pre-tighten spring, thus making the moving plate closely contacted to the fixed plate.

In another preferred embodiment, the control component comprises a gear shaft and a driving element, the moving plate is fixed to the driving element; one end of the gear shaft is disposed with a cam laterally protruded, the driving element is disposed with a cavity to dispose the cam, the gear shaft extends into the driving element, the cam, when rotating, abuts the two walls of the driving element respectively, the driving element moves in different directions to drive the moving plate to move with respect to the fixed plate.

In another preferred embodiment, the control component further comprises a crank, a solenoid, a knob and a torsional spring, the gear shaft passes through the crank to connect to the knob, the gear shaft, the crank and the knob form a linkage connection, the torsional spring is assembled to the crank and pushes the crank with a torsion force, thus forming a trend to drive the on-off component to close; the crank is disposed with a crank hole, when the on-off component is open, the solenoid is locked inside the crank hole.

In another preferred embodiment, the control component comprises a gear shaft, one end of the gear shaft is disposed with a cam laterally protruded, the moving plate is fixed to the cam; the cam, when rotating, drives the moving plate to move with respect to the fixed plate.

In another preferred embodiment, the control component further comprises a pre-tighten shaft and a pre-tighten spring, the pre-tighten shaft is disposed between the moving plate and the cam, the pre-tighten spring is disposed between the pre-tighten shaft and the cam, thus making the moving plate closely contacted to the fixed plate.

In another preferred embodiment, the control component further comprises a lever enlarging handle, a crank, a solenoid, a knob and a torsional spring, the lever enlarging handle is eccentric, one end of the lever enlarging handle is disposed with a lock step, while the other end of the lever enlarging handle is disposed with a lock groove to lock to a clip disposed in the crank; the gear shaft passes through the crank to connect to the knob, the gear shaft, the crank and the knob form a linkage connection, the torsional spring is assembled to the crank and pushes the crank with a torsion force, thus forming a trend to drive the on-off component to close; when the on-off component is open, the solenoid is locked to the lock step of the lever enlarging handle.

In another preferred embodiment, the control component further comprises a connecting sleeve, the connecting sleeve is sleeved between the gear shaft and the crank, the connecting sleeve is disposed with a straight hole, one end of the pre-tighten shaft is locked inside the straight hole, thus implementing the straight movement of the moving plate.

In another preferred embodiment, the housing is disposed with a thumbstall in the position of the solenoid, the thumbstall, when pressed, drives the solenoid to move, so that to manual control the solenoid to release the lever enlarging handle.

In another preferred embodiment, the water level inductor of the water tank comprises a hook, a stand, a slide block, a float, a PCB housing and a inductor PCB board, the hook is disposed in the stand, the hook hangs in the water tank; one end of the slide block is fixed to the top end of the PCB housing, the other end is slidably connected to the stand; the float is slidably connected to the PCB housing, the float is disposed with a magnet.

In another preferred embodiment, the bottom of the PCB housing is disposed with a limit rib, the float moves in the PCB housing between the slide block and the limit rib.

In another preferred embodiment, one side of the stand is disposed with ribs, the other side is disposed with protruding rib, one side on the internal surface of the slide block is disposed with grooves, the grooves are cooperated to the ribs; the other side of the slide block is disposed with a lock catch, the lock catch is cooperated to the protruding rib, when the lock catch escapes from the protruding rib, the slide block is adjustable, when the lock catch locks to the protruding rib, the slide block keeps still.

In another preferred embodiment, a securing layer is filled between the inductor PCB board and the PCB housing.

In another preferred embodiment, the inductor PCB board is disposed with reed switches in different heights according to different water levels, the float is disposed with a magnet, the magnet is cooperated to the reed switches for water level identification.

In another preferred embodiment, the water level inductor of the toilet comprises a level switch, a setting rack, a sealing pad, a press board and a lock sleeve, the level switch is assembled to one end of the setting rack, the other end of the setting rack passes through the side wall of the toilet, and locks the sealing pad and then the press board to the toilet by the lock sleeve.

In another preferred embodiment, the water level inductor of the toilet comprises a level switch, an output pipe, a sealing ring and a sealing O ring, the level switch is assembled to the lower end of the output pipe, the output pipe is disposed inside the water tank, the level switch passes through the water tank then into the toilet; the output pipe is assembled to the bottom of the water tank by a setting holder; the setting holder is an external threaded pipe with an upper flange in the upper end, the setting holder is fixed to the external wall of the output pipe, the external threaded section of the setting holder inserts into the toilet, and is rotationally connected with a locknut with an external lower flange; when assembling, rotating the locknut, the upper flange of the setting holder and the lower flange of the locknut screw the bottom wall of the water tank; the setting holder and the water tank, the locknut and the top surface of the toilet, the setting holder and the output pipe are sealed by sealing rings or sealing O rings; when the toilet is plugged up and the water level reaches to the induction position of the level switch, the waterway is cut off after a period of time.

In another preferred embodiment, the level switch comprises a shaft sleeve, a ball float and a limiting piece, the ball float is movably sleeved to the shaft sleeve, the shaft sleeve is disposed with reed switches inside, the ball float is disposed with a magnet; the limiting piece is assembled to the lower end of the shaft sleeve, the upper end of the shaft sleeve is assembled to the setting rack.

The advantages of the present invention are:

1. with the water level inductor to induct the water tank and the toilet, the present invention implements detection of the failure of the inlet valve or the drain valve and the plug of the toilet, it also implements automatic close of the inlet, thus solving the problems that the water tank or the toilet is leaking water when the inlet valve is failed and continues in water inflow, the drain valve is failed to discharge, or when the toilet is plugged up and is unable to drain water.
2. the automatic control device will automatically cut off the water supply when above cases happen, and it alarms, for example a LED light shines. And when user finds out the situation and solves it, by pulling operation, it recovers water supply, which overcomes the worries behind.

BRIEF DESCRIPTION OF THE DRAWINGS

FIG. 4(*b*) illustrates a fourth mode of the first embodiment when it is open.

FIG. 5 (*b*) illustrates a fifth mode of the first embodiment when it is open.

Figure 1:
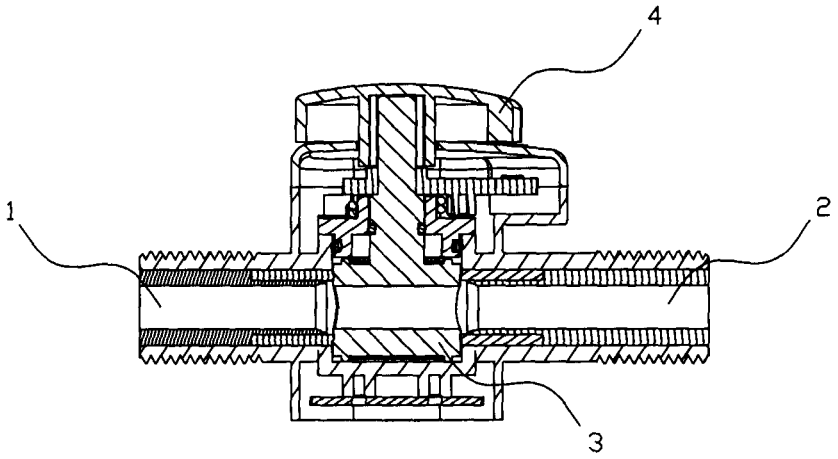
FIG. 1 illustrates a first mode of the first embodiment.

Reference signs: main controller 100, water level inductor of the water tank 200, water level inductor of the toilet 300, inlet 1, outlet 2, rotating shaft with a hole 3, knob 4, moving shaft 5, cam 6, fixed plate 7, moving plate 8, water hole 9, driving shaft 10, control circuit 11, gear shaft 12, rack 13, slide shaft 14, connecting element of the rack 15, crank 16, solenoid 17, main spring 18, crank hole 19, pressing element 20, pre-tighten spring 21, assembly position of the main spring 22, lock teeth 23, assembly position f the slide shaft 24, hook 25, stand 26, slide block 27, float 28, PCB housing 29, inductor PCB board 30, limit rib 31, rib 32, protruding rib 33, groove 34, lock catch 35, reed switch 36, level switch 37, setting rack 38, sealing pad 39, press board 40, lock sleeve 41, shaft sleeve 42, ball float 43, limit piece 44, gear shaft 45, driving element 46, setting holder 47, upper flange 471, locknut 472, lower flange 473, sealing ring 481, sealing O ring 482, output pipe 49, connecting wire 50, torsional spring 51, cam 52, lever enlarging handle 53, lock step 54, lock groove 55, clip 56, thumbstall 57, connecting sleeve 58, straight hole 59, pre-tighten shaft 60.

DETAILED DESCRIPTION OF THE EMBODIMENTS

The present invention will be further described with the drawings and the embodiments.

The First Embodiment

An automatic protect device when the inlet valve or the drain valve is failed or when the toilet is plugged up comprising an inlet 1, an outlet 2, a on-off component, a control circuit 11, a control component, a water level inductor of the water tank 200 and a water level inductor of the toilet 300, the water level inductor of the water tank 200 and the water level inductor of the toilet 300 are respectively connected to the control circuit 11, the control circuit 11 drives the control component, the control component is connected to the on-off component to control the open and close of the on-off component, thus implementing the connection and the disconnection of the inlet 1 and outlet 2. thereinto, the inlet 1, the outlet 2, the on-off component, the control circuit 11 and the control component compose the main controller 100 and are assembled between the water resource pipe and the inlet end of the inlet valve.

A first mode is figured out in FIG. 1, the on-off component is a rotating shaft with a hole 3, when the rotating shaft with a hole 3 rotates in a different angle, it cuts off the water supply or opens the water supply. When there is a failure, under the operation of the control circuit 11, the control component drives the rotating shaft with a hole 3 to rotate automatically, thus implementing the close of the water supply; when the failure is cleared, turn the knob 4 by hand, the rotating shaft with a hole 3 is repositioned to open the water supply.

Figure 2:
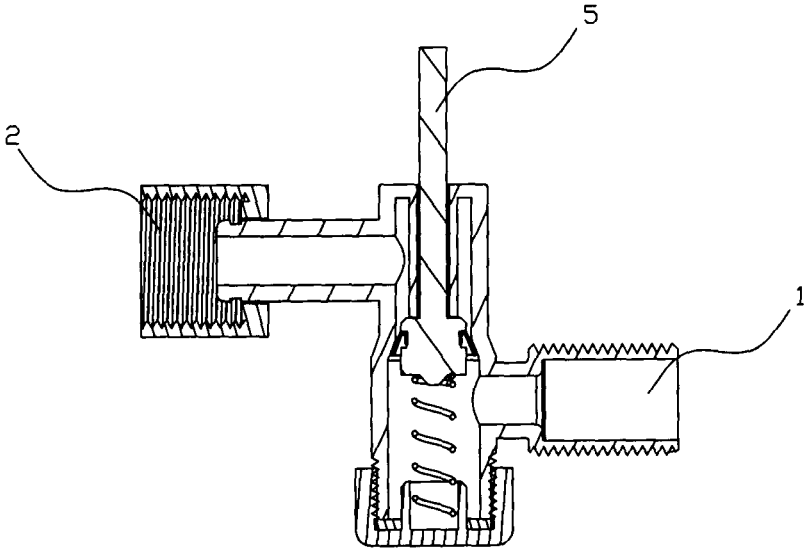
FIG. 2 illustrates a second mode of the first embodiment.

A second mode is figured out in FIG. 2, the on-off component is a moving shaft 5 moving up and down, the inlet 1 and the outlet 2 are disposed in the body, with the moving of the moving shaft 5 up and down, the moving shaft 5 opens or closes the waterway from the inlet 1 to the outlet 2, thus implementing the open or close of the water supply. The automatic control method is similar to the first mode.

Figure 3:
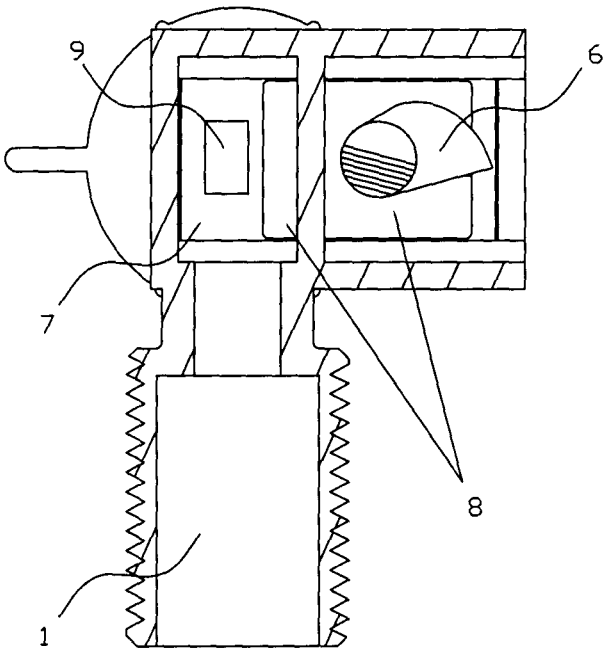
FIG. 3 illustrates a third mode of the first embodiment.

A third mode is figured out in FIG. 3, the on-off component comprising a gear shaft 45, a fixed plate 7 and a moving plate 8. The fixed plate 7 is disposed with a water hole 9 and is fixed, the moving plate 8 can move along different directions under the driving of the gear shaft 45. When the gear shaft 45 rotates to a different direction, it drives the moving plate 8 to move left or right, thus implementing the open or close of the water hole 9 of the fixed plate 7, the open or close of the waterway. The automatic control method is similar to the first mode.

Figure 4A:
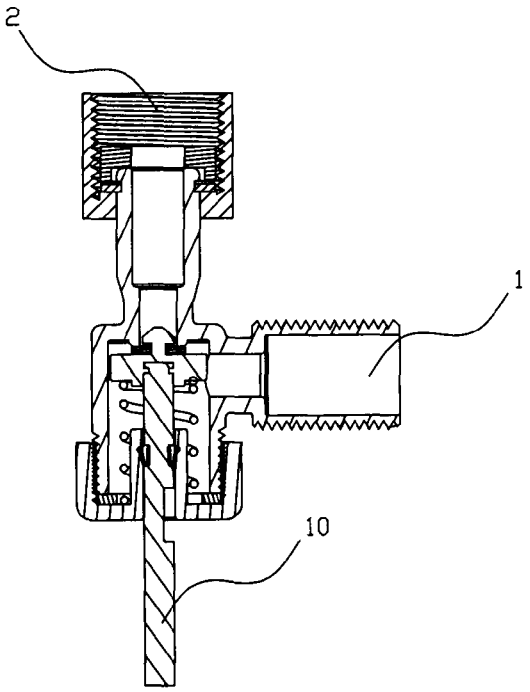
FIG. 4(*a*) illustrates a fourth mode of the first embodiment when it is closed.
Figure 4B:
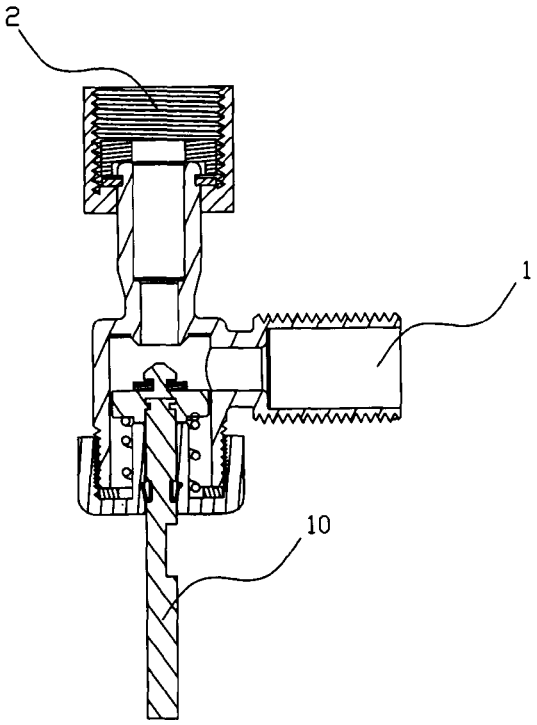

A fourth mode is figured out in FIG. 4(*a*) and FIG. 4(*b*), the on-off component is a driving shaft 10 moving up and down, the inlet 1 and the outlet 2 are disposed in the body, with the moving up or down of the driving shaft 10, the outlet 2 is open or closed by the driving shaft 10, thus implementing the open or close of the water supply. The automatic control method is similar to the first mode.

Figure 5A:
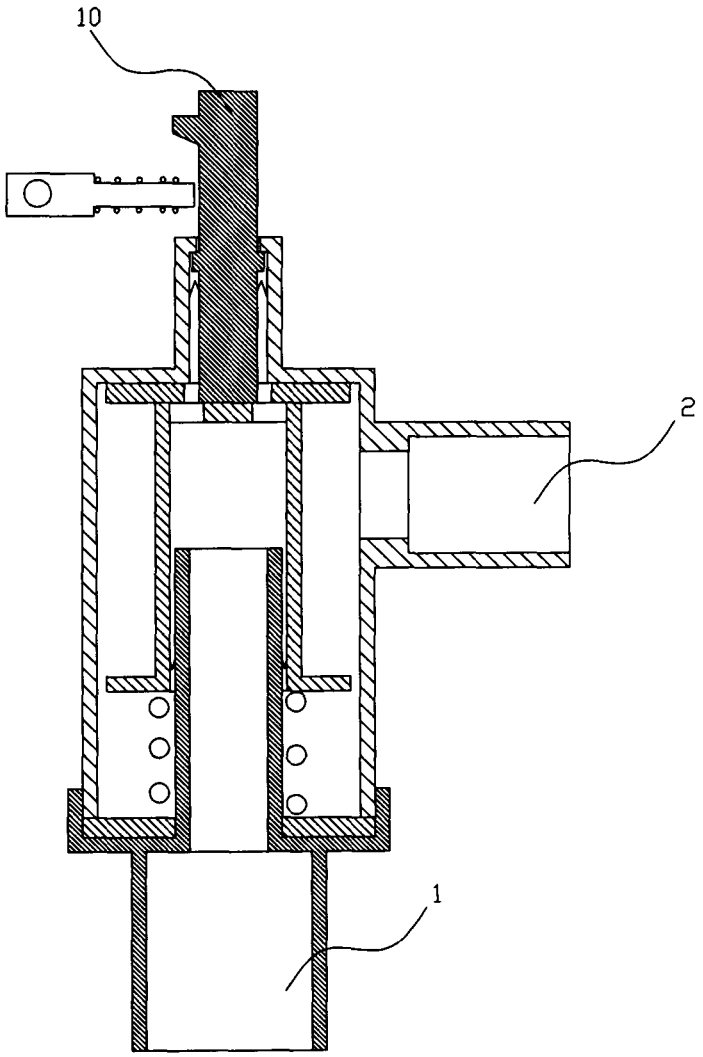
FIG. 5 (*a*) illustrates a fifth mode of the first embodiment when it is closed.
Figure 5B:
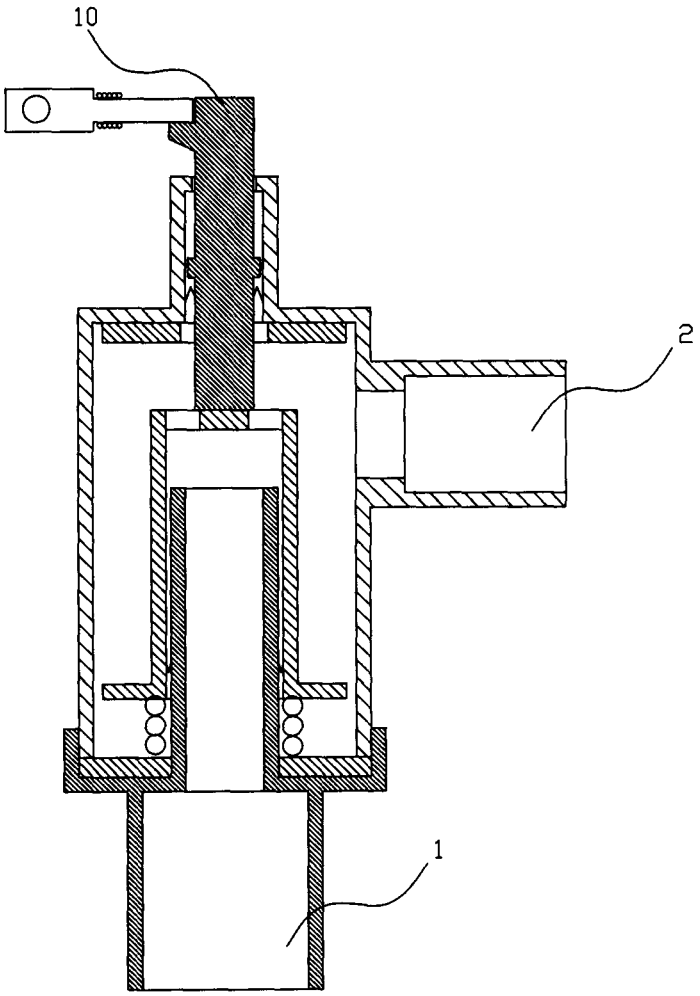

A fifth mode is figured in FIG. 5(*a*) and FIG. 5(*b*), the on-off component is a driving shaft 10 moving up and down, the inlet 1 and the outlet 2 are disposed in the body, the inlet 1 is connected to the driving shaft 10, the driving shaft 10 is disposed with an indirect outlet hole, with the moving up or down of the driving shaft 10, the indirect outlet hole is open or closed, thus implementing the open or close of the water supply. The automatic control method is similar to the first mode.

The Second Embodiment

Figure 22:
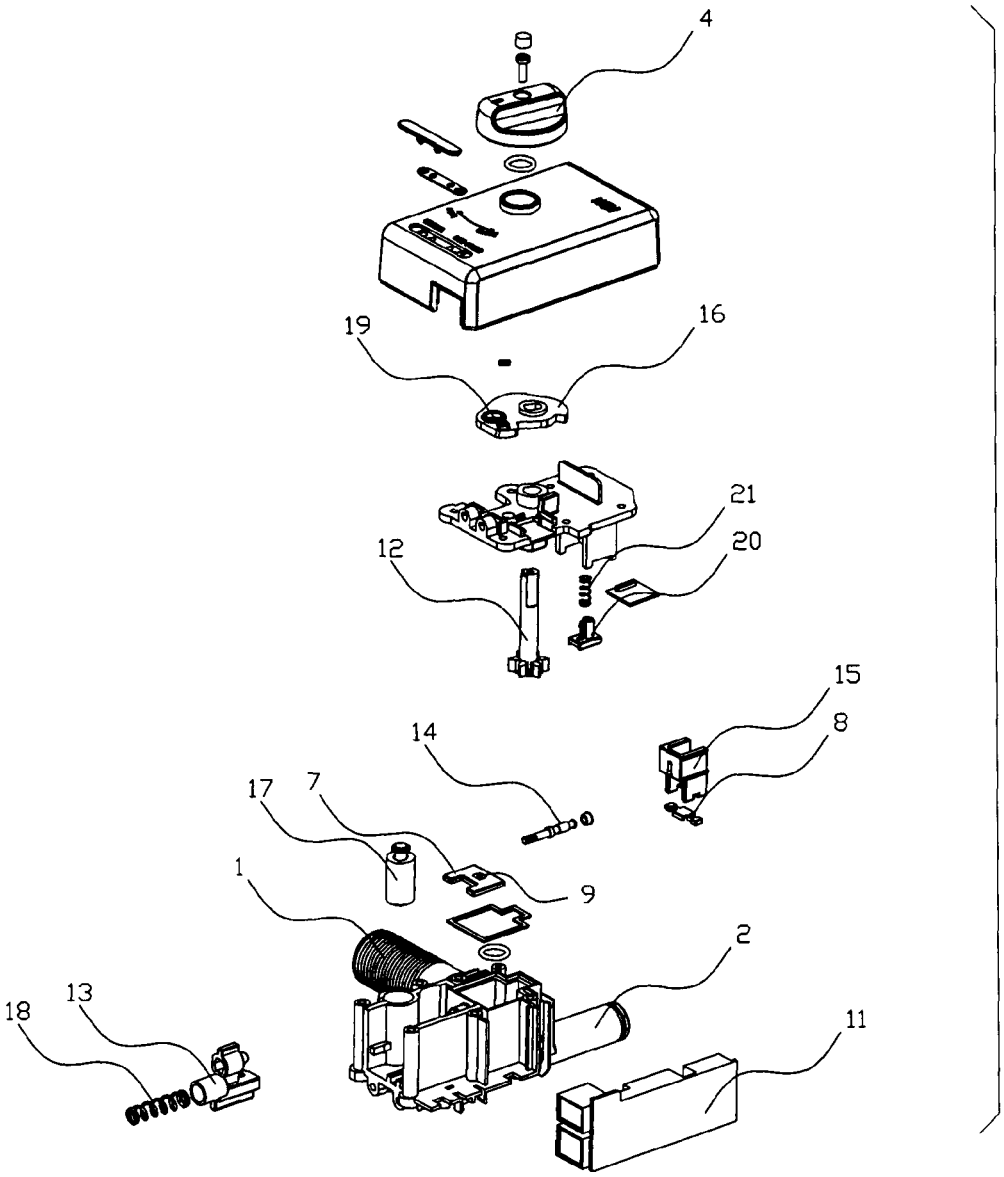
FIG. 22 illustrates a partial schematic and exploded diagram of the second embodiment.

As figured in FIG. 22, an automatic protect device when the inlet valve or the drain valve is failed or when the toilet is plugged up comprising an inlet 1, an outlet 2, a on-off component, a control circuit 11, a control component, a water level inductor of the water tank 200 and a water level inductor of the toilet 300, the water level inductor of the water tank 200 and the water level inductor of the toilet 300 are respectively connected to the control circuit 11, the control circuit 11 drives the control component, the control component is connected to the on-off component to control the open or close of the control component, thus implementing the on-off of the inlet 1 and outlet 2. thereinto, the inlet 1, the outlet 2, the on-off component, the control circuit 11 and the control component compose the main controller 100 and are assembled between the water resource pipe and the inlet end of the inlet valve. FIG. 22 illustrates the main component of the device, other common components, such as the battery, the box body, etc, will not be detailed described here.

Figure 6:
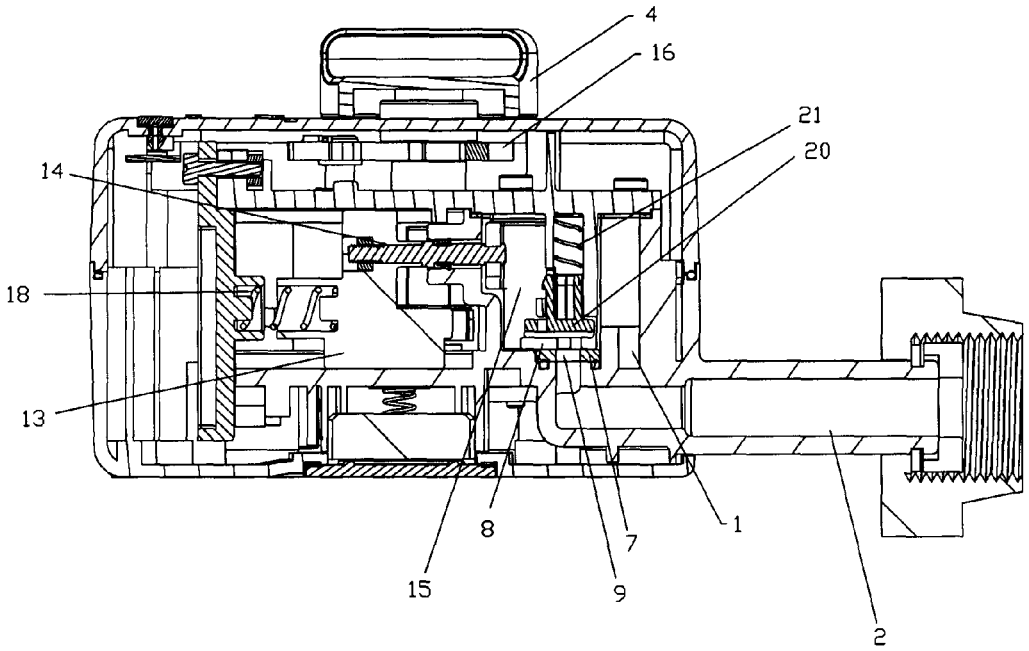
FIG. 6 illustrates a front sectional view of the second embodiment.
Figure 7:
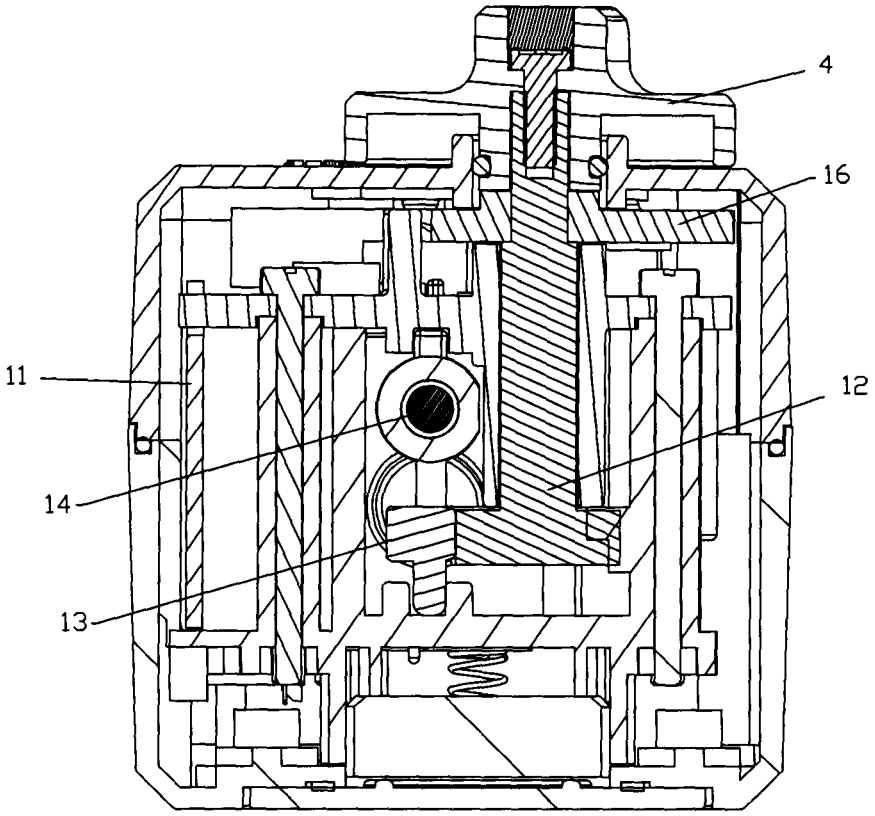
FIG. 7 illustrates a right side sectional view of the second embodiment.

As figured in FIG. 6 and FIG. 7, in this embodiment, the on-off component comprising a moving plate 8 and a fixed plate 7. The fixed plate 7 is disposed with a water hole 9, the moving plate 8 is closely contacted to the fixed plate 7, the moving plate 8 moves with respect to the fixed plate 7, thus forming the open or close of the water hole 9, thus implementing the open or close of the water flowing.

The control component comprising a gear shaft 12, a rack 13, a slide shaft 14 and a connecting element 15 of the rack 13. The gear shaft 12 is engaged to the rack 13, one end of the slide shaft 14 is fixed to the rack 13, while the other end is fixed to the connecting element 15 of the rack 13, the moving plate 8 is fixed to the connecting element 15 of the rack 13; when the gear shaft 12 rotates, it drives the rack 13 to move, thus driving the slide shaft 14 to drive the connecting element 15 of the rack 13 to move, thus driving the moving plate 8 to move with respect to the fixed plate 7.

To make sure that the water is supplied again just after the failure is removed, this embodiment is provided with a manual recovering function. During actual practice, the control component further comprising a crank 16, a solenoid 17, a knob 4 and a main spring 18, the gear shaft 12 passes through the crank 16 to connect with the knob 4, the gear shaft 12, the crank 16 and the knob 4 form a linkage connection, the main spring 18 abuts against the rack 13 to push the rack 13, thus forming a trend to drive the on-off component to close; the crank 16 is disposed with a crank hole 19, when the on-off component is situated in open, the solenoid 17 is locked inside the crank hole 19.

To make the moving plate 8 more closely contacted to the fixed plate 7, a pressing element 20 is disposed to abut against the moving plate 8 in the front, the pressing element 20 works on the moving plate 8 by a pre-tighten spring 21, thus making the moving plate 8 more closely contacted to the fixed plate 7.

Figure 8:
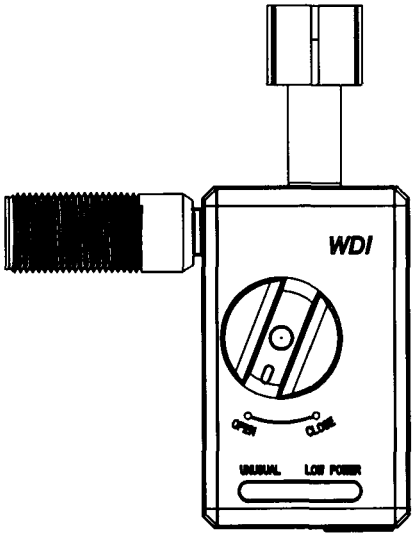
FIG. 8 illustrates the second embodiment when it is open.
Figure 9:
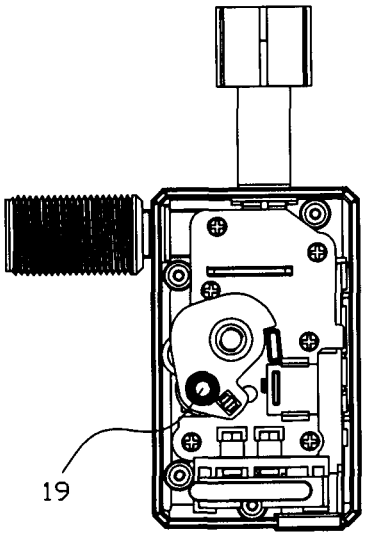
FIG. 9 illustrates a sectional view of the second embodiment when it is open.

As figured in FIG. 8, when turning the knob 4 to OPEN position by hand, the crank hole 19 is locked to the head of the solenoid 17, as figured in FIG. 9. When the knob 4 is rotating, the crank 16 drives the gear shaft 12 to move to make the rack 13 moved; the rack 13 drives the connecting element 15 of the rack 13 to move by the slide shaft 14, meanwhile the upper ceramic tablet and the lower ceramic tablet stagger, water flows out of the outlet to supply water.

Figure 10:
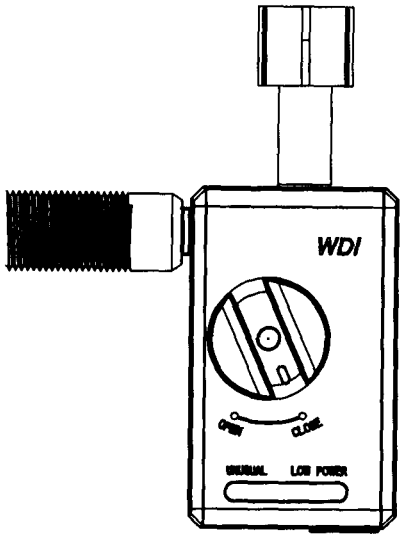
FIG. 10 illustrates the second embodiment when it is closed.

When the water level inductor of the water tank 200 or the water level inductor of the toilet 300 sense that the level changes, it sends signal to the control circuit 11, when the control circuit 11 receives the signal, it further processes: the solenoid 17 is powered to make the head contracted, the crank hole 19 slips from the solenoid 17 under the work of the main spring 18, at the same time, the crank 16 drives the gear shaft 12 to move to drive the crack 13 to move; the crack 13 drives the connecting element 15 of the crack 13 to move by the slide shaft 14, now the moving plate 8 is overlapped on the fixed plate 7, water can't flow through the water hole 9, thus making the water supply closed. As figured in FIG. 10, the knob 4 is automatically set in CLOSE position.

Figure 11:
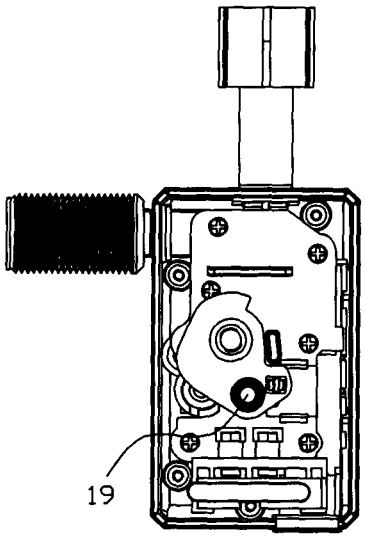
FIG. 11 illustrates a sectional view of the second embodiment when it is closed.

In addition, the alarm information is disposed with a turnoff board and an LED light. As figured in FIG. 11, at the time the water supply is closed, when the crank 16 is turned to the turnoff board, the magnet on the crank 16 is connected to the reed switch 36 (magnetic reed) of the turnoff board, the LED red light flashes to alarm, indicating that the toilet or the inlet valve or the drain valve of the water tank is failed and has to repair, after examine and repair, turn the knob 4 to OPEN position by hand to supply water again. If the power of battery is low, the LED greenlight flashes; if the battery is out of power, it turned off the circuit automatically. When the toilet is failed, for example the main spring 18 is weak, the waterway is unable to close, the crank 16 can not turn to the turnoff board, the magnet of the crank 16 can not connect to the reed switch 36 of the turnoff board, the LED red light and the LED green light flash alternately.

Figure 12:
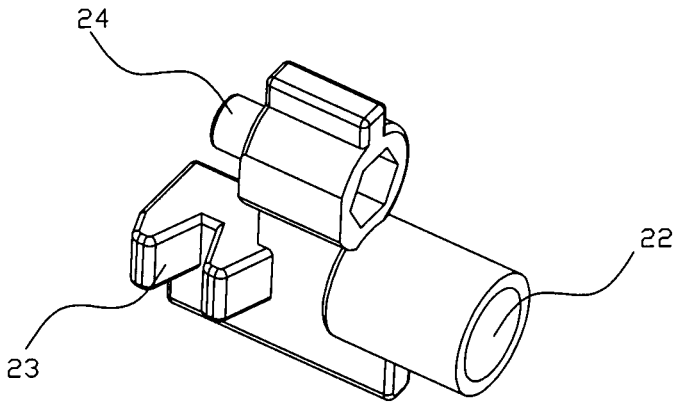
FIG. 12 illustrates a schematic diagram of the rack of the second embodiment.

The structure of the rack 13 is as figured in FIG. 12, it comprising an assembly position 22 of the main spring in the front, lock teeth 23 in the side and an assembly position 24 of the slide shaft at the top, the assembly position 22 of the main spring is used to assemble the main spring 18, the assembly position 24 of the slide shaft is used to assemble the slide shaft 14. the lock teeth 23 are used to engage with the gear shaft 12, driven by the gear shaft 12, the lock teeth 23 move in the horizontal direction.

In addition to the automatic control, when other abnormal situation happeds and it has to close the water supply, there is manual close method.

Figure 13:
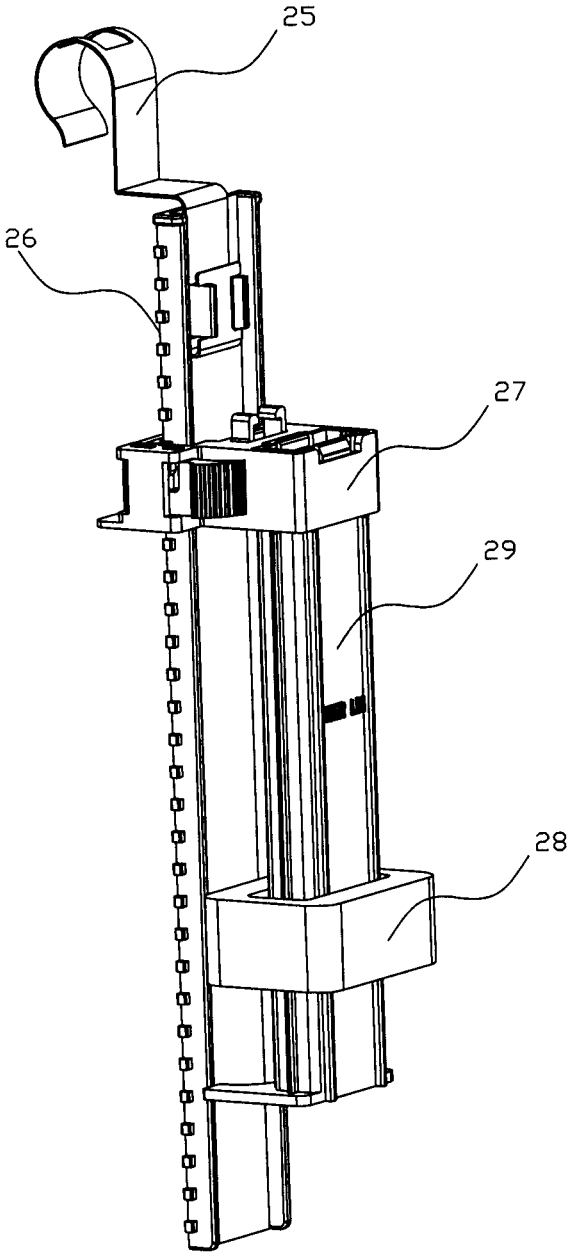
FIG. 13 illustrates a schematic diagram of the water level inductor of the water tank of the second embodiment.
Figure 14:
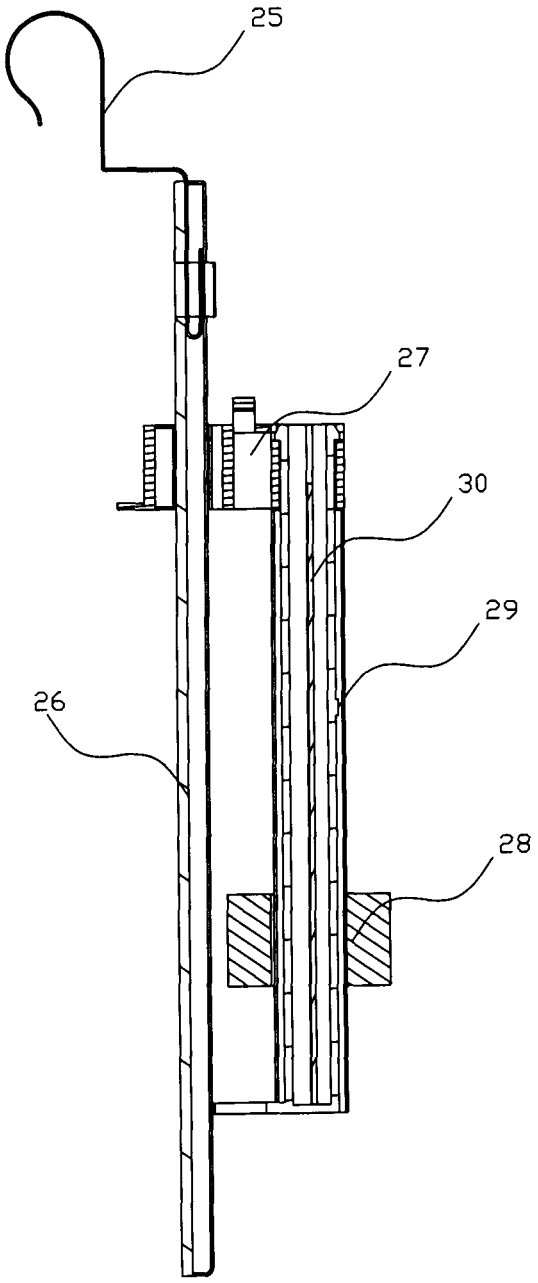
FIG. 14 illustrates a left side view of the water level inductor of the water tank of the second embodiment.
Figure 19:
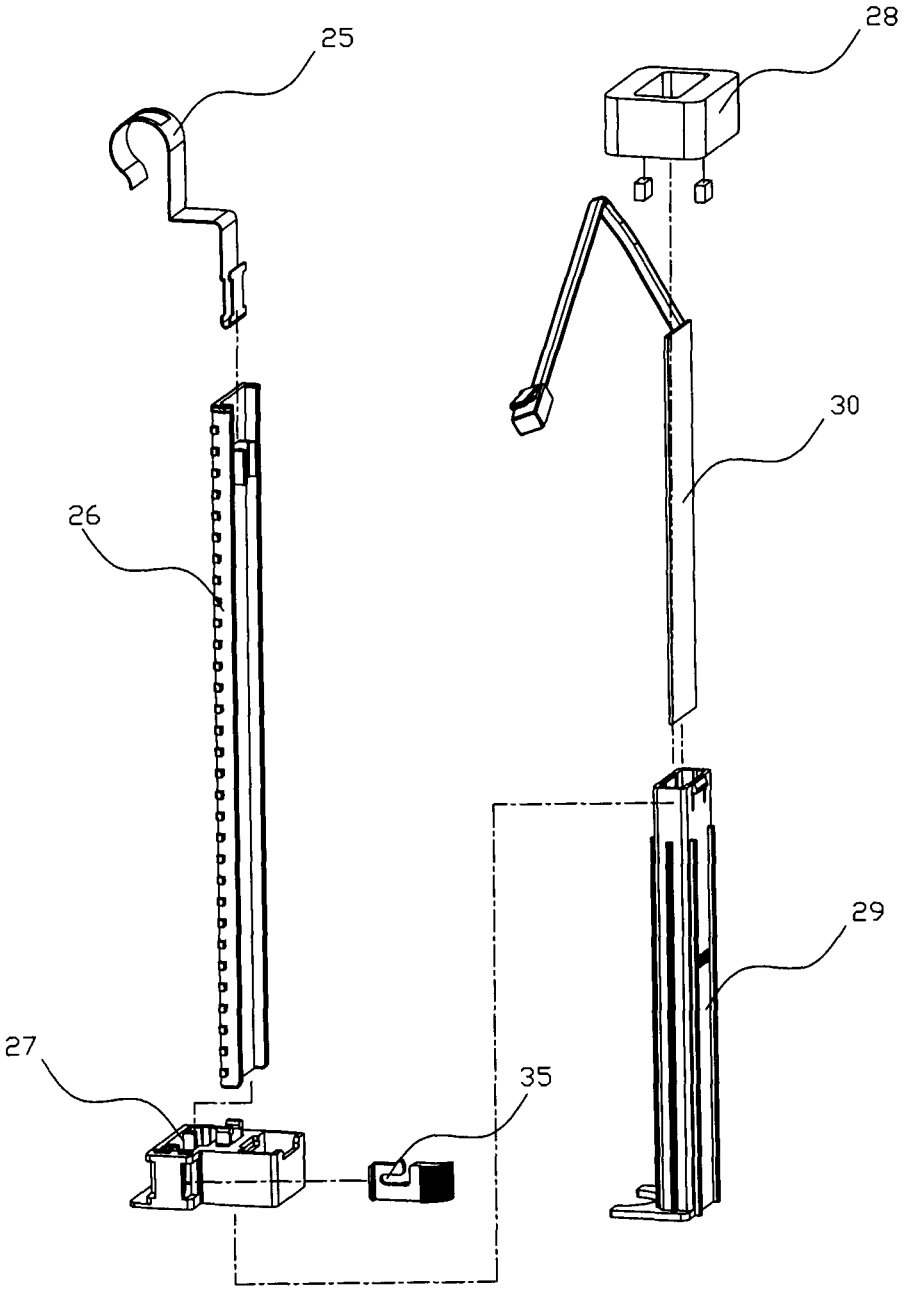
FIG. 19 illustrates a schematic and exploded diagram of the board of the second embodiment.

As figured in FIG. 13, FIG. 14 and FIG. 19, the water level inductor of the water tank 200 comprising a hook 25, a stand 26, a slide block 27, a float 28, a PCB (Printed Circuit Board) housing 29 and an inductor PCB board 30, the hook 25 is assembled to the rack 26, the hook 25 is hanging in the water tank; one end of the slide block 27 is fixed to the top end of the PCB housing 29, while the other end is slidably connected to the rack 26; the float 28 is slidably connected to the PCB housing 29, the float 28 is disposed with a magnet inside.

For accurate output the detect result, hope no detect error happens due to the movement of the inductor PCB board 30, a securing layer is filled between the inductor PCB board 30 and the PCB housing 29, preventing the inductor PCB board 30 from moving outside the PCB housing, preventing an excursion of the pre-set water level which leads to inaccurate result.

Figure 15:
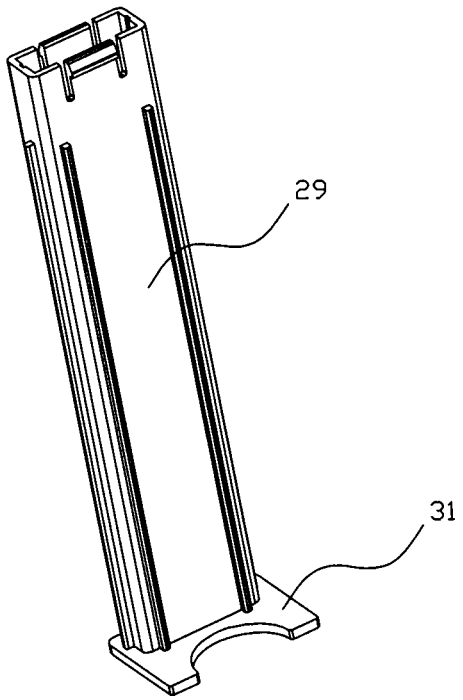
FIG. 15 illustrates a schematic diagram of the PCB housing of the second embodiment.

To prevent the float 28 from sinking, to prevent it from dropping due to low water level, or to prevent it from stuck at the bottom of the PCB housing 29, as figured in FIG. 15, the bottom of the PCB housing 29 is disposed with limiting rib 31, the float 28 moves between the slide block 27 and the limiting rib 31 in the PCB housing 29.

When the inlet valve is failed, the float 28 rises to the highest, and when it keeps for 1-5 seconds (or other periods), the water level inductor of the water tank 200 is powered; when the drain valve is failed, the float 28 moves from the moving area to the lowest area and then back to the moving area (a cycle) 5 times back and forward (or other times), and the period reaches to 2-5 minutes (or other period), the water level inductor of the water tank 200 is powered. When the drain valve is failed, the float 28 falls down to the lowest area for 10 minutes (or other periods), the water level inductor of the water tank 200 is powered.

Figure 16:
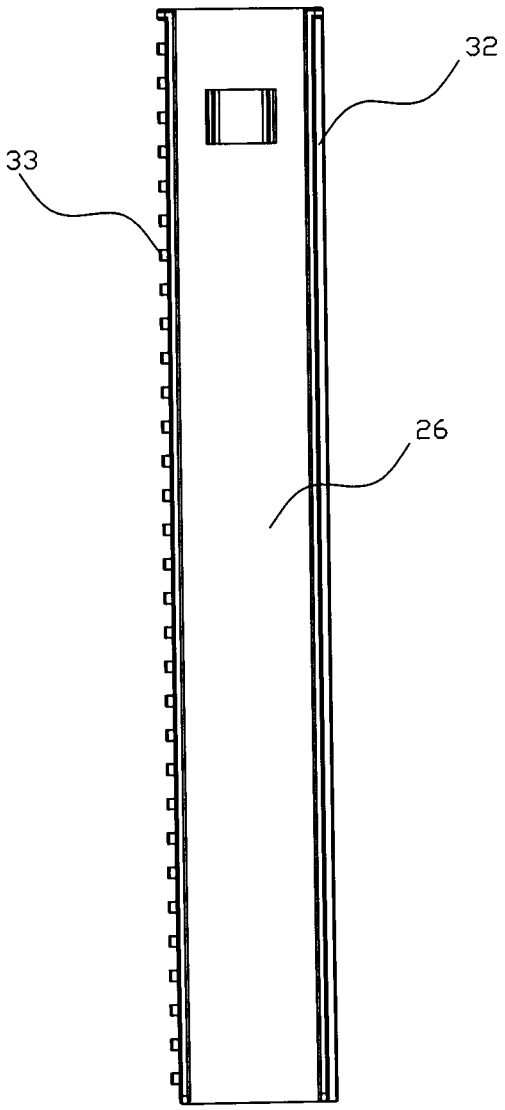
FIG. 16 illustrates a schematic diagram of the stand of the second embodiment.
Figure 17:
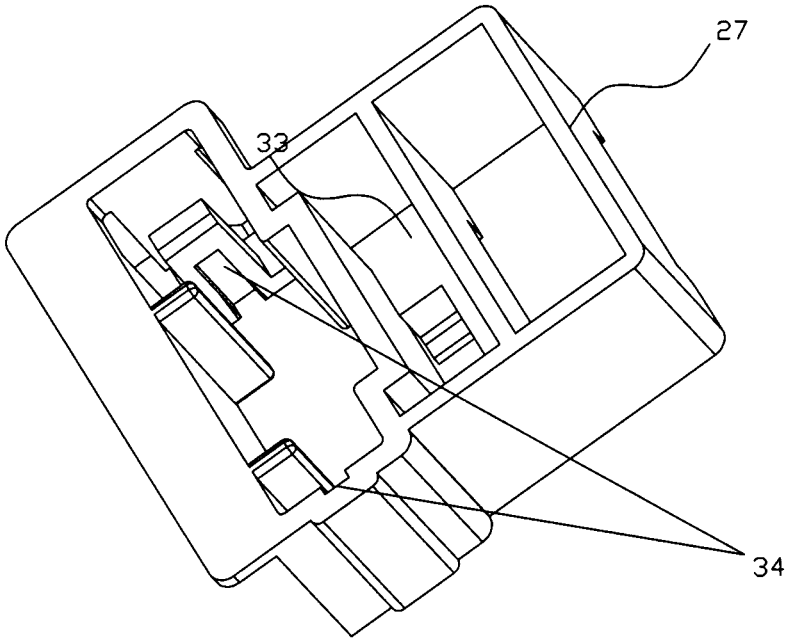
FIG. 17 illustrates a schematic diagram of the slide block of the second embodiment.

As figured in FIG. 16, one side of the stand 26 is disposed with ribs 32, while the other side is disposed with protruding rib 33. As figured in FIG. 17, one side of internal surface of the slide block 27 is disposed with a groove 34, the groove 34 is cooperated to the ribs 32; the other side of the slide block 27 is disposed with a lock catch 35 (a moving lock catch or a rotating lock catch), the lock catch 35 is cooperated to the protruding rib 33, when the lock catch 35 is away from the protruding rib 33, the slide block 27 is adjustable, when the lock catch 35 is locked to the protruding rib 33, the slide block 27 stays still and does not slide.

Figure 18:
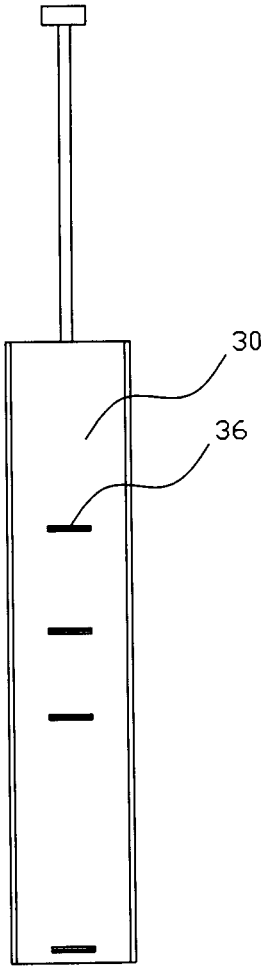
FIG. 18 illustrates a schematic diagram of the inductor PCB board of the second embodiment.

In this embodiment, the inductor PCB board 30 is disposed with reed switches 36 of different heights according to different water levels, as figured in FIG. 18, the float 28 is disposed with a magnet, and the magnet is cooperated with the reed switches 36, thus implementing the identification of the water level.

Figure 20:
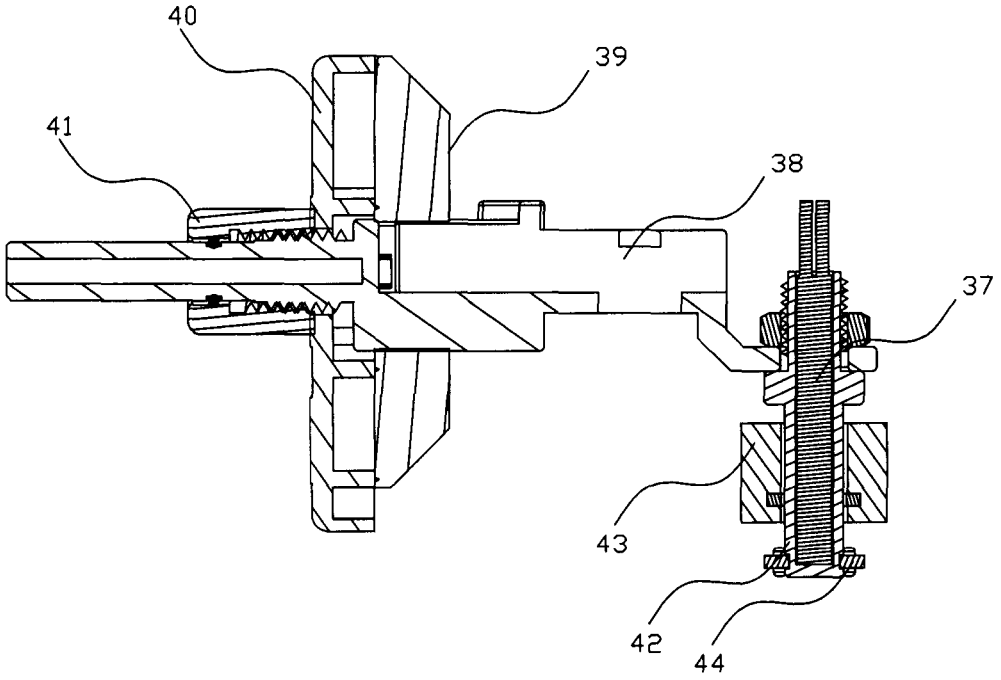
FIG. 20 illustrates a sectional view of the board of the second embodiment.
Figure 21:
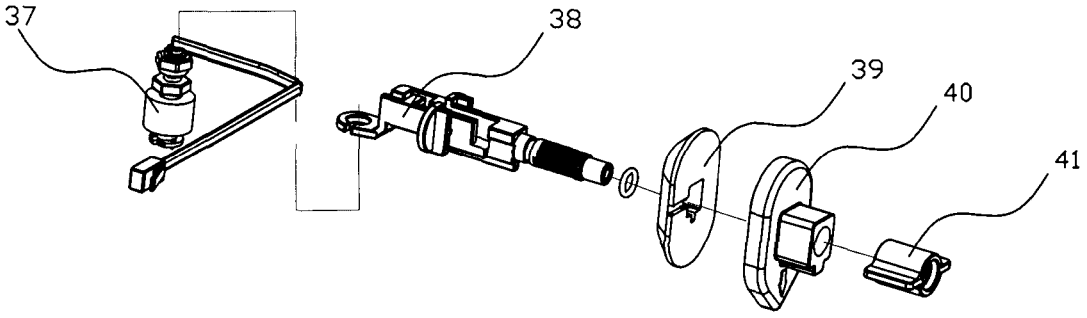
FIG. 21 illustrates a schematic and exploded diagram of the water level inductor of the toilet of the second embodiment.

As figured in FIG. 20 and FIG. 21, the water level inductor of the toilet 300 comprises a level switch 37, a setting rack 38, a sealing pad 39, a press board 40 and a lock sleeve 41 the level switch 37 is assembled in one end of the setting rack 38, the other end of the setting rack 38 passes through the side wall of the toilet, and locks the sealing pad 39 and then the press board 40 to the toilet by the lock sleeve 41.

In detailed, the level switch 37 comprises a shaft sleeve 42, a ball float 43 and a limiting piece 44, the ball float 43 is movably sleeved to the shaft sleeve 42, the shaft sleeve 42 is disposed with reed switches 36 inside, the ball float 43 is disposed with a magnet inside; the limiting piece 44 is assembled in the lower end of the shaft sleeve 42, the upper end of the shaft sleeve 42 is fixed to the setting rack 38.

When the toilet is plugged up and the water keeps rising, the level switch 37 rises, and the magnet inside rises as well, when it reaches to a certain height, the water level inductor of the toilet 300 is powered, and it sends alarm signal to the control circuit 11, the control circuit 11 then cuts off the inlet watery and alarms (by sound or light signal).

The Third Embodiment

Figure 23:
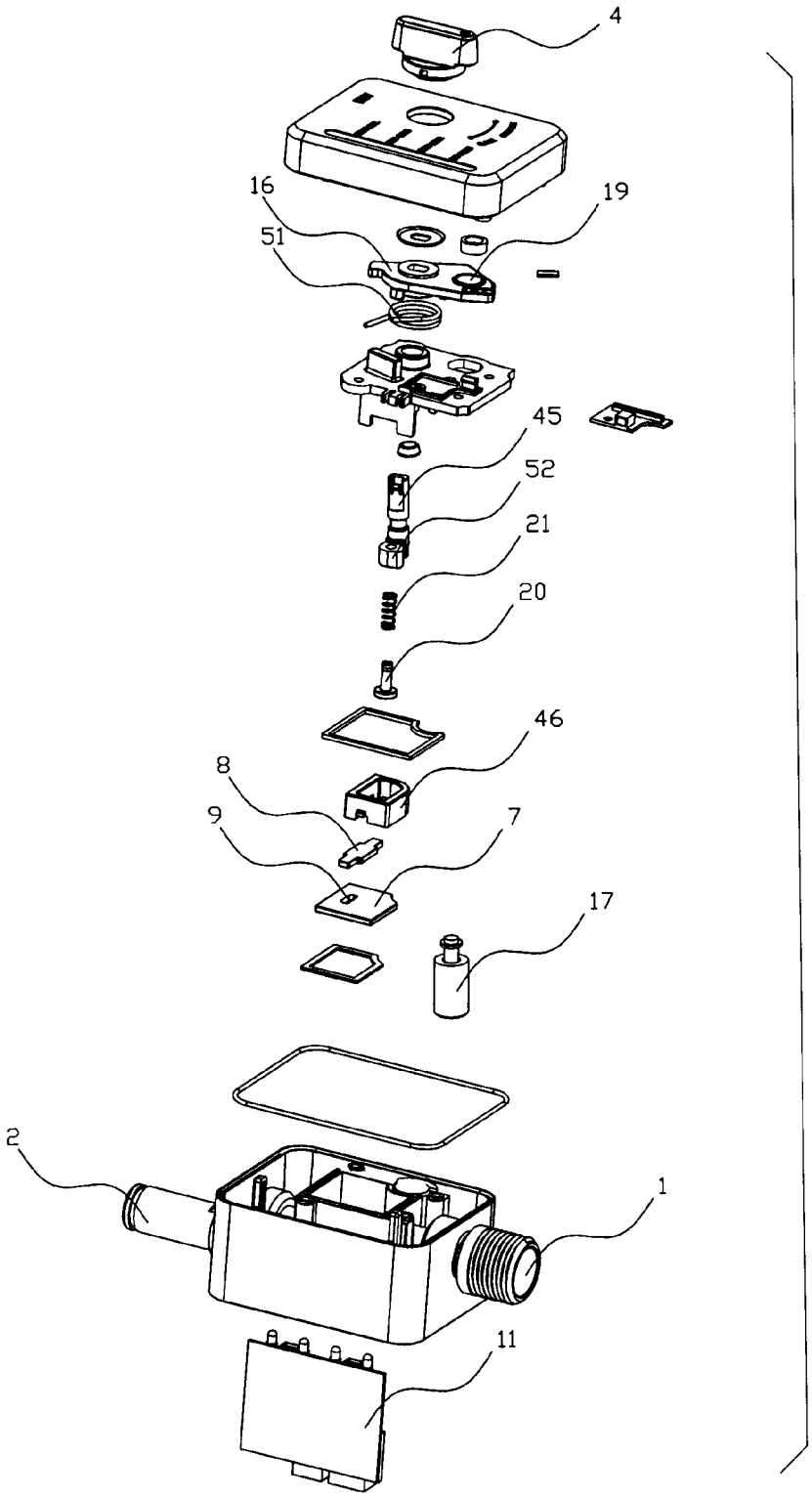
FIG. 23 illustrates a partial schematic and exploded diagram of the third embodiment.
Figure 24:
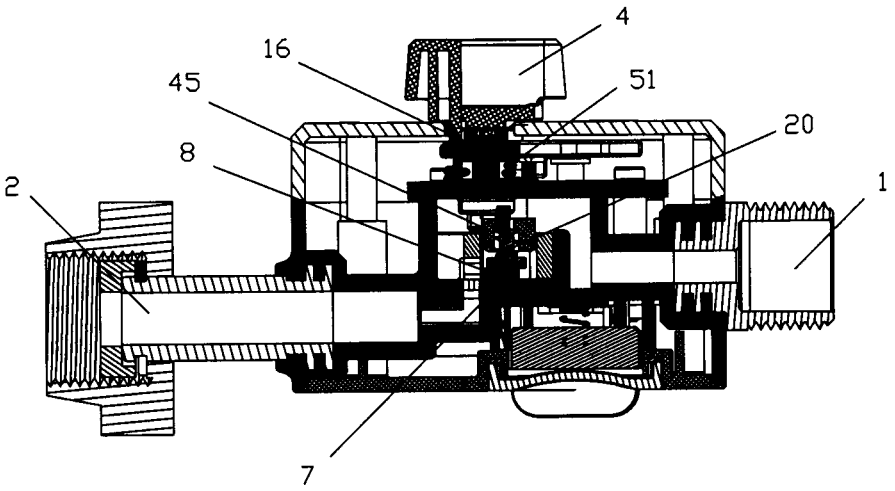
FIG. 24 illustrates a front sectional view of the third embodiment.
Figure 25:
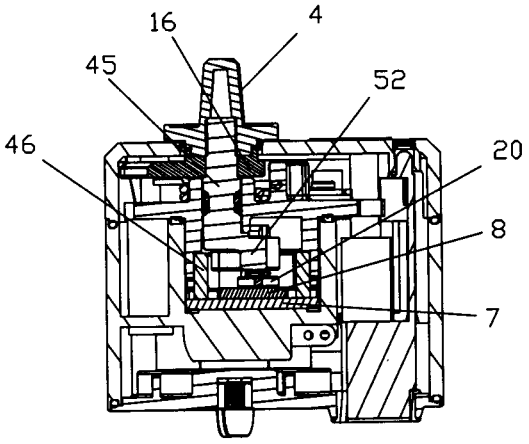
FIG. 25 illustrates a right side sectional view of the third embodiment.

As figured in FIG. 23, FIG. 24 and FIG. 25, the control component of this embodiment comprises a gear shaft 45 and a driving element, the moving plate 8 is fixed to the driving element; one end of the shaft of the gear shaft 45 is disposed with a cam 52 laterally protruded, the driving element is disposed with a cavity to dispose the cam 52, the gear shaft extends into the driving element, when the cam 52 rotates (47.5 degrees), it abuts two walls of the driving element respectively, the driving element moves in different directions, and drives the moving plate 8 to move with respect to the fixed plate 7. FIG. 23 illustrates the main components of the device, other common components like battery or box body are not detailed described here.

The control component further comprises a crank 16, a solenoid 17, a knob 4 and a torsional spring 51, the gear shaft 45 passes through the crank 16 to connect to the knob 4. the gear shaft 45, the crank 16 and the knob 4 form a linkage connection, the torsional spring 51 is assembled to the crank 16 to push torsion stress to the crank 16, thus forming a trend to drive to close the on-off component; the crank 16 is disposed with a crank hole 19, when the on-off component is open, the solenoid 17 is locked to the crank hole 19.

Figure 26:
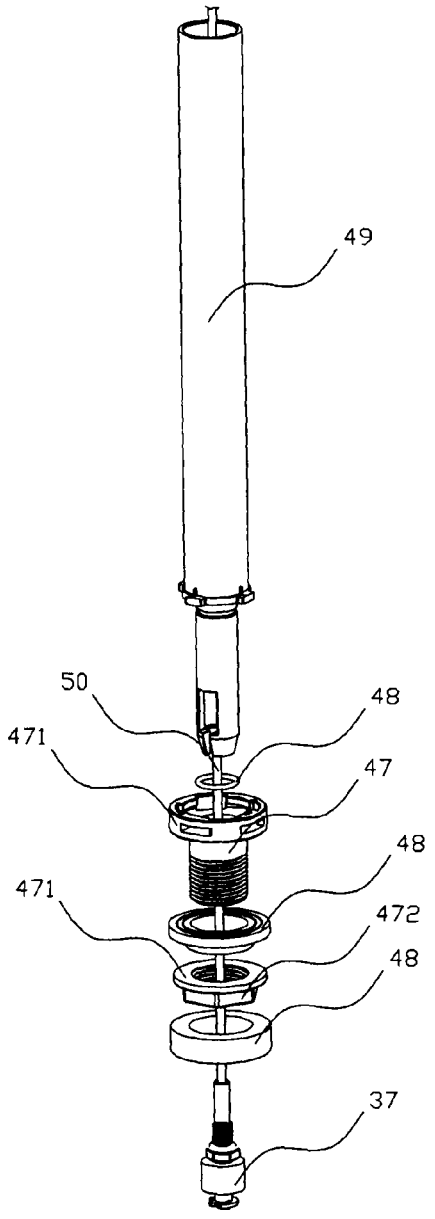
FIG. 26 illustrates an exploded diagram of the water level inductor of the water tank of the third embodiment.
Figure 27:
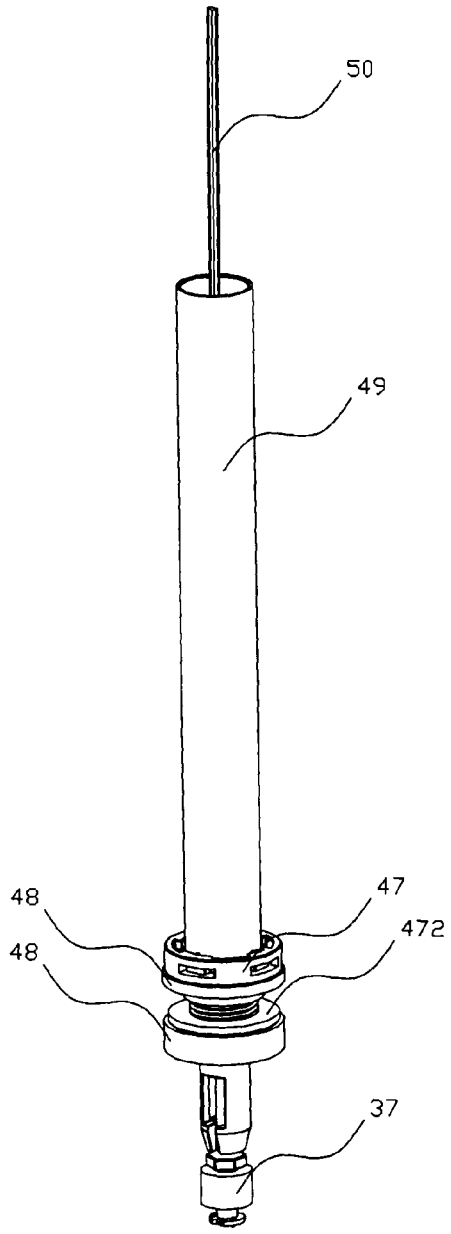
FIG. 27 illustrates an assembly diagram of the water level inductor of the water tank of the third embodiments.
Figure 28:
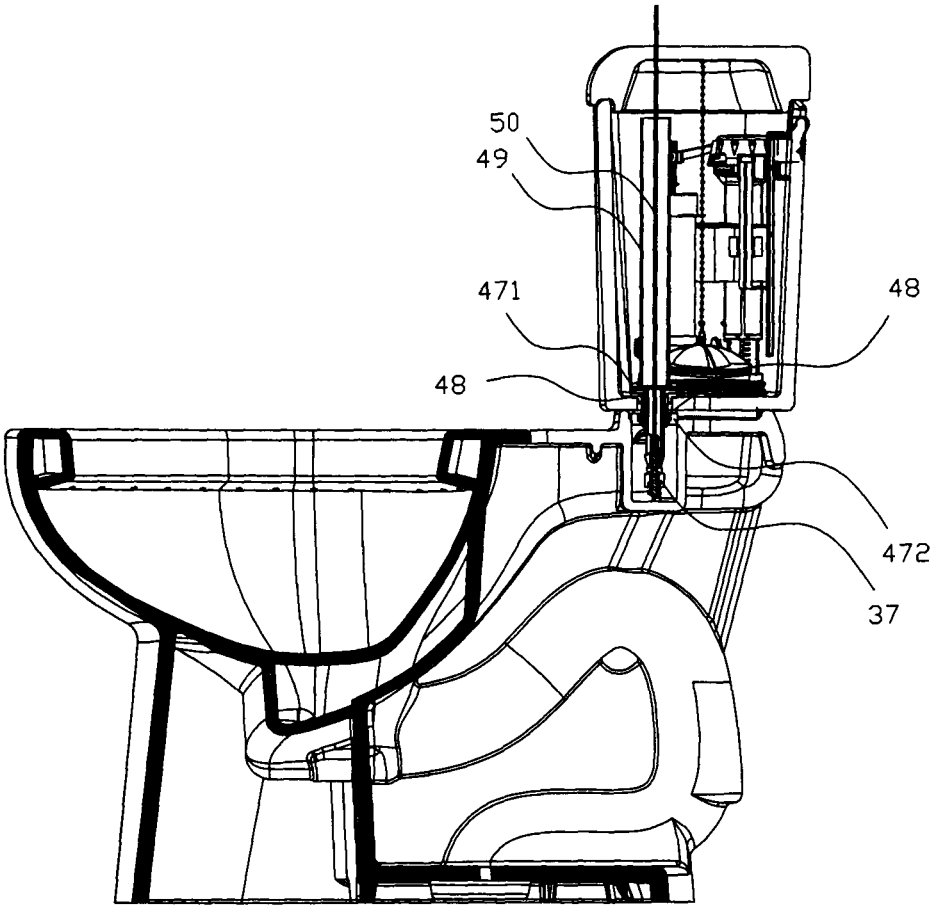
FIG. 28 illustrates an installation diagram of the water level inductor of the water tank of the third embodiment.

As figured in FIG. 26, FIG. 27, FIG. 28, the water level inductor of the toilet 300 of this embodiment comprises a level switch 37, a output pipe 49, a sealing ring 481 and a sealing O ring 482, the level switch 37 is disposed in the lower end of the output pipe 49, the top end of the level switch 37 is connected with a connecting wire 50, the connecting wire 50 passes through the output pipe 49 and hangs. The output pipe 49 is disposed inside the water tank, the level switch 37 passes through the water tank then into the toilet; the lower end of the output pipe 49 and the level switch 37 passes through an installing hole of the water tank then to a spraying waterway of the toilet; the detection lower limit of the level switch 37 to the water level is a water level of the toilet reaching to the spraying waterway. The output pipe 49 is assembled to the lower portion of the water tank by a setting holder 47 in sealing way; the setting holder 47 is an external threaded pipe with an upper flange 471, the setting holder 47 is fixed to the external wall of the output pipe 49, the external threaded section of the setting holder 47 is inserted into the toilet, and is rotationally connected with a locknut 472 with an external lower flange 473; when assembling, rotating the locknut 472, the upper flange 471 of the setting holder 47 and the lower flange 473 of the locknut 472 screw the bottom wall of the water tank; the setting holder 47 and the water tank, the locknut 472 and the top surface of the toilet, the setting holder 47 and the output pipe 49 are sealed therebetween by sealing rings 481 or sealing O rings 482; in this embodiment, the setting holder 47 and the water tank, the locknut 472 and the top surface of the toilet are sealed therebetween by sealing rings 481, the setting holder 47 and the output pipe 49 are sealed by a sealing O ring 482. when the toilet is plugged up and the water level reaches to the induction position of the level switch 37, the waterway is cut off after a period of time.

Figure 29:
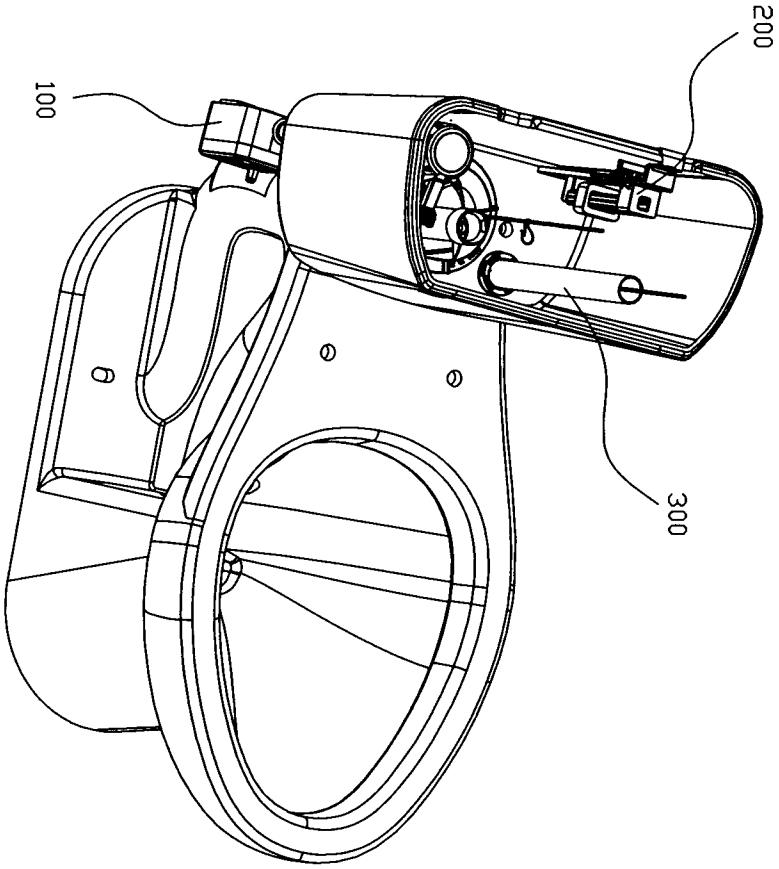
FIG. 29 illustrates an installation diagram of the third embodiment.
Figure 30:
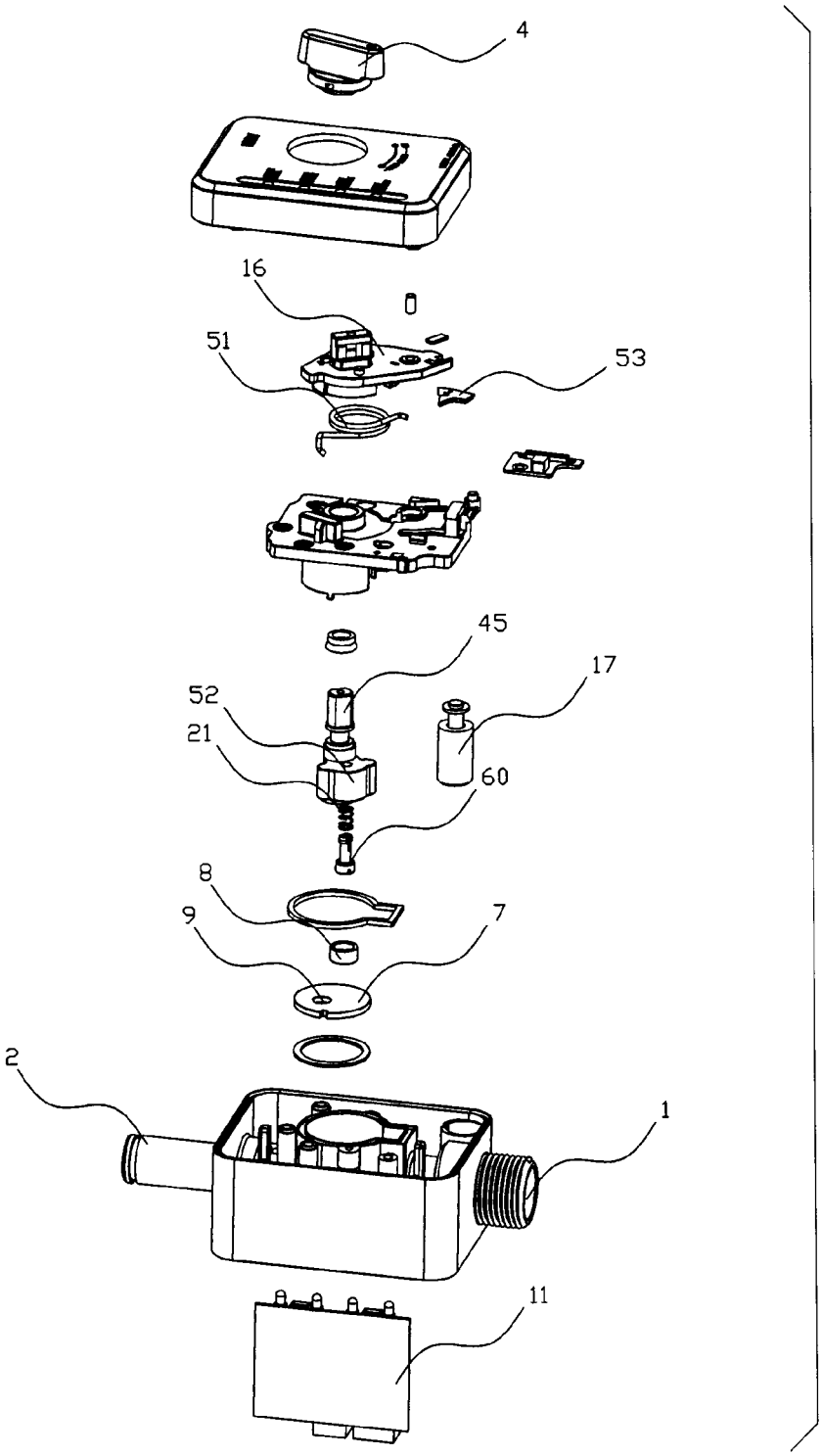
FIG. 30 illustrates a partial schematic and exploded diagram of the fourth embodiment.
Figure 31:
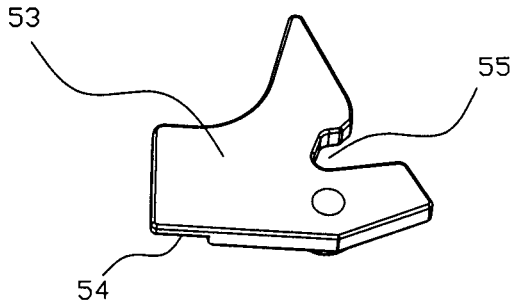
FIG. 31 illustrates a front view of the lever enlarging handle.
Figure 32:
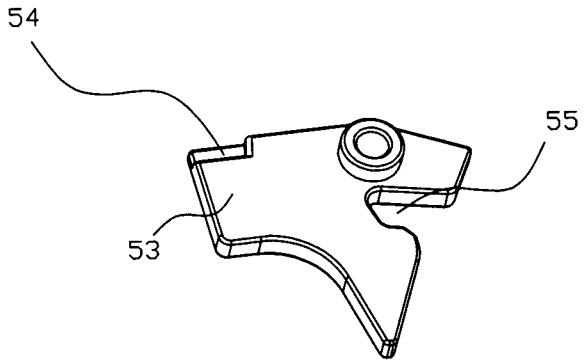
FIG. 32 illustrates a back view of the lever enlarging handle.
Figure 33:
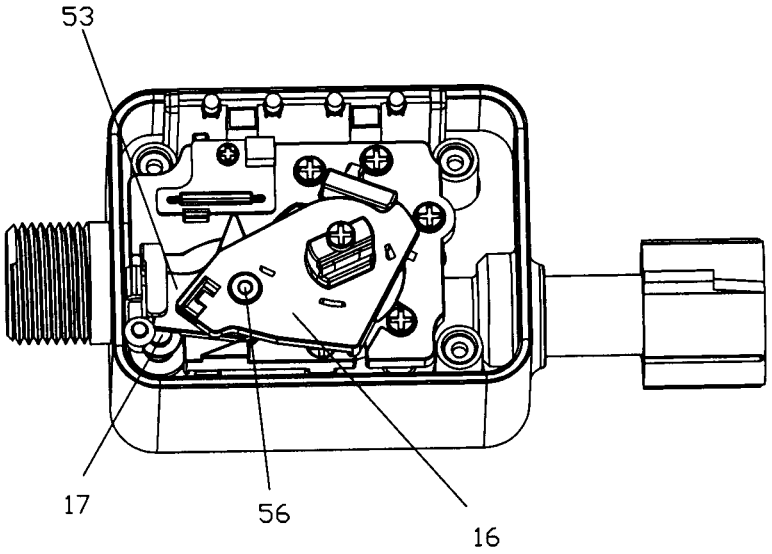
FIG. 33 illustrates the structure of the fourth embodiment when it is open.
Figure 34:
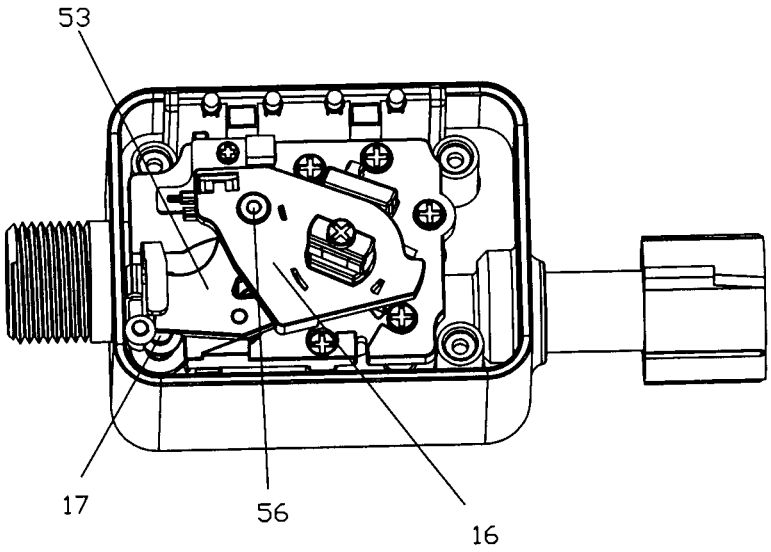
FIG. 34 illustrates the structure of the fourth embodiment when it is closed.

When used, as figured in FIG. 29, the main controller 100 is assembled outside the water tank between the water resource pipe and the inlet end of the inlet valve, the water level inductor of the water tank 200 hangs on the side wall of the water tank inside the water tank, the water level inductor of the toilet is fixed to the bottom wall of the water tank inside the water tank.

Other parts of this embodiment are similar to the second embodiment.

The Fourth Embodiment

In this embodiment, as figured in FIG. 30, FIG. 31, FIG. 32, FIG. 33 and FIG. 34, the control component comprises a gear shaft 45, a pre-tighten shaft 60, a pre-tighten spring 21, a lever enlarging handle 53, a crank 16, a solenoid 17, a knob 4 and a torsional spring 51. one end of the gear shaft 45 is disposed with a cam 52 laterally protruded, the moving plate 8 is secured to the cam 52; when the cam 52 rotates, it drives the moving plate 8 to move with respect to the fixed plate 7. the pre-tighten shaft 60 is assembled between the moving plate 8 and the cam 52, the pre-tighten spring 21 is assembled between the pre-tighten shaft 60 and the cam 52, thus implementing that the moving plate 8 tightly abuts against the fixed plate. To enlarge the arm of force of the crank 16 indirectly, and to reduce the force the solenoid 17 pushed so as to make the solenoid 17 easier to escape, this embodiment is disposed with the lever enlarging handle 53. the lever enlarging handle 53 is eccentric, one end of the lever enlarging handle 53 is disposed with a lock step 54, while the other end is disposed with a lock groove 55, which is used to lock to a clip 56 disposed in the crank 16; the gear shaft 45 passes through the crank 16 to connect to the knob 4, the gear shaft 45, the crank 16 and the knob 4 form a linkage connection, the torsional spring 51 is assembled to the crank 16 to push a torsion force to the crank 16, thus forming a trend to drive the on-off component to close; when the on-off component is open, the solenoid 17 is locked to the lock step 54 of the lever enlarging handle 53. after the solenoid 17 moves, the core of the solenoid 17 moves downwards, the lock step 54 of the lever enlarging handle 53 escapes from the solenoid 17, and rotates in counterclockwise direction by the push of the crank 16. When the clip 56 of the crank 16 escapes from the lock groove 55 of the lever enlarging handle 53, the crank 16 rotates in clockwise direction to close position of the waterway under the work of the torsional spring 51. Meanwhile, the reed switch of the inductor PCB board in the close position is powered, LED shines to indicate abnormity.

Figure 35:
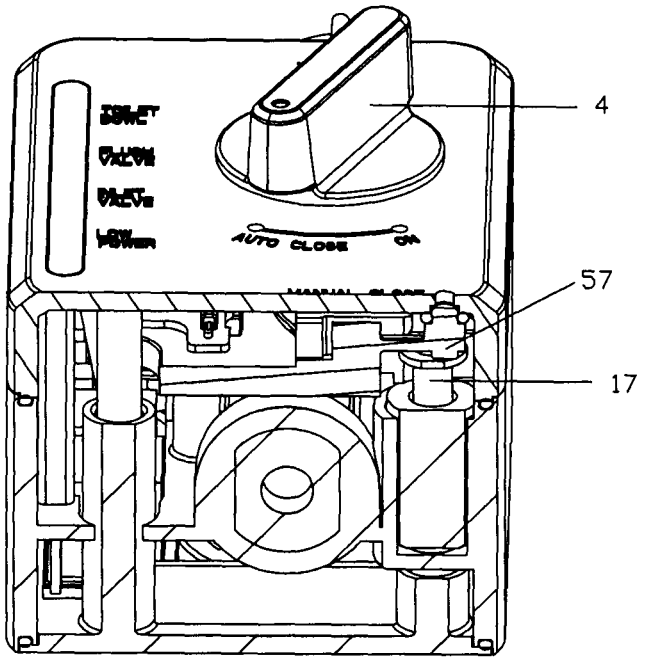
FIG. 35 illustrates the structure of the thumbstall.
Figure 36:
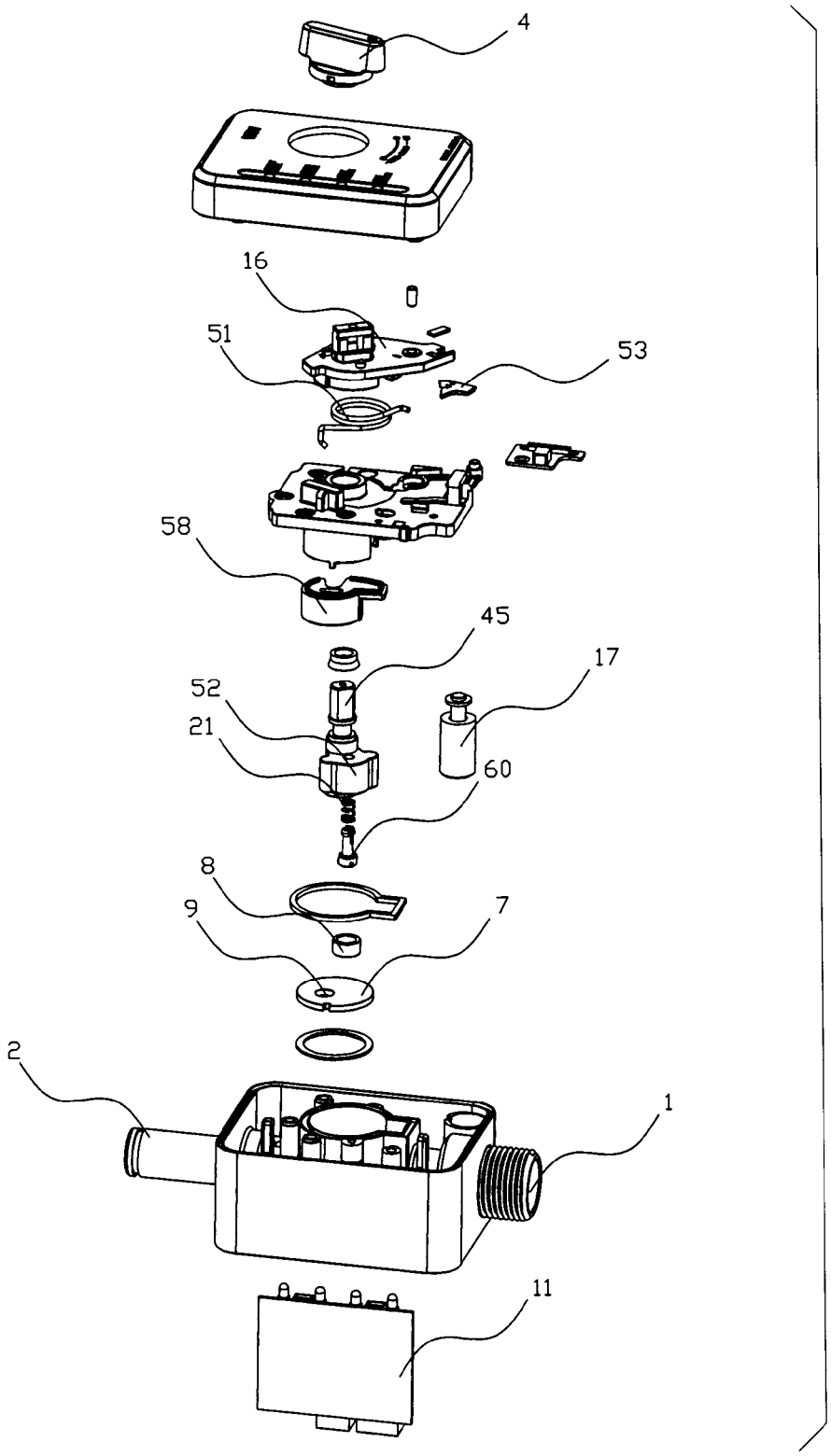
FIG. 36 illustrates a partial exploded diagram of the fifth embodiment.
Figure 37:
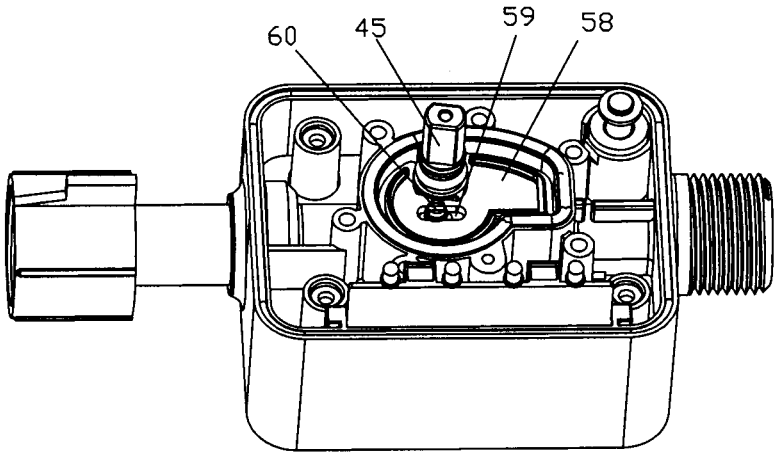
FIG. 37 illustrates a usage diagram of the connecting sleeve.
Figure 38:
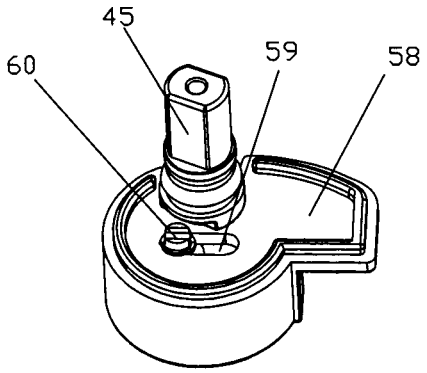
FIG. 38 illustrates a principle diagram of the connecting sleeve.
Figure 39:
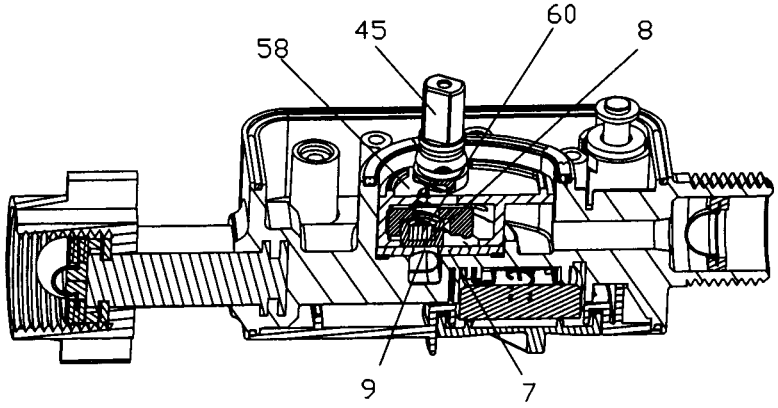
FIG. 39 illustrates a sectional view of the connecting sleeve of the fifth embodiment when it is closed.
Figure 40:
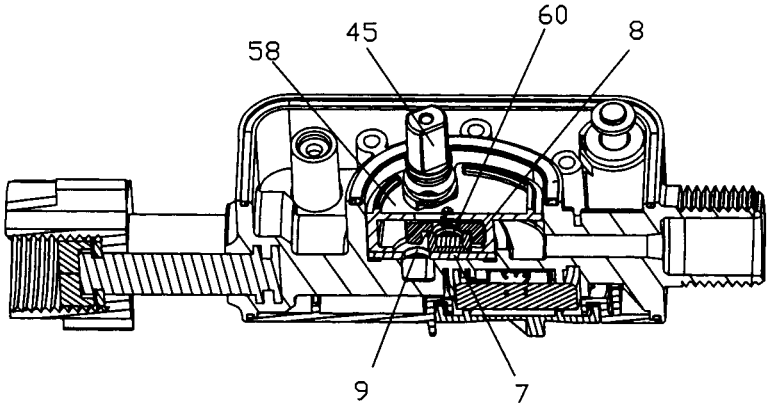
FIG. 40 illustrates a sectional view of the connecting sleeve of the fifth embodiment when it is open.

For manual operation convenient, as figured in FIG. 35, the housing is disposed with a thumbstall 57 in the position of the solenoid 17 to manual control the solenoid 17 to release the lever enlarging handle 53. when the thumbstall 57 is pressed, it drives the solenoid 17 to move, the core of the solenoid 17 moves downwards, meanwhile the lever enlarging handle 53 escapes the limit of the solenoid 17 to rotate in counterclockwise direction, so that the crank 16 escapes from the limit of the lever enlarging handle 53 to rotate in clockwise direction, then finally reach to the close position of the waterway.

Other parts of this embodiment are similar to the second embodiment.

The Fifth Embodiment

As figured in FIG. 36, FIG. 37, FIG. 38, FIG. 39 and FIG. 41, the control components of this embodiment, based on the fourth embodiment, further comprises a connecting sleeve 58, the connecting sleeve 58 is sleeved between the gear shaft 45 and the crank 16, the connecting sleeve 58 is disposed with a straight hole 59, one end of the pre-tighten shaft 60 is locked inside the straight hole 59, thus implementing the straight movement of the moving plate 8. the pre-tighten shaft 60 passes through the straight hole 59. with the limit of the straight hole 59, the cam of the gear shaft 45 moves in a line, and drives the moving plate 8 to move in a light with respect to the fixed plate 7.

Other parts of this embodiment are similar to the fourth embodiment.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

The invention claimed is:

1. An automatic protect device when an inlet valve or a drain valve is failed or when a toilet is plugged up comprising an inlet, an outlet, an on-off component, a control circuit, a control component, a water level inductor of the water tank and a water level inductor of the toilet, the water level inductor of the water tank and the water level inductor of the toilet are respectively connected to the control circuit, the control circuit drives the control component, the control component is connected to the on-off component to control the on-off component to open or close, thus implementing the connection or the disconnection of the inlet and the outlet, a main controller comprises the inlet, the outlet, the on-off component, the control circuit and the control component, the main controller is assembled between a water resource pipe and the inlet end of the inlet valve, wherein the on-off component comprising a moving plate and a fixed plate, the fixed plate is disposed with a water hole, the moving plate is closely contacted to the fixed plate, the moving plate moves with respect to the fixed plate, so that the water hole is open or closed, thus implementing the open or close of the water flowing, the control component comprises a gear shaft, one end of the gear shaft is disposed with a cam laterally protruded, the moving plate is fixed to the cam;

the cam, when rotating, drives the moving plate to move with respect to the fixed plate, the control component further comprises a pre-tighten shaft and a pre-tighten spring, the pre-tighten shaft is disposed between the moving plate and the cam, the pre-tighten spring is disposed between the pre-tighten shaft and the cam, thus making the moving plate closely contacted to the fixed plate, the control component further comprises a connecting sleeve, the connecting sleeve is sleeved between the gear shaft and the crank, the connecting sleeve is disposed with a straight hole, one end of the pre-tighten shaft is locked inside the straight hole, thus implementing the straight movement of the moving plate.

2. An automatic protect device when the inlet valve or the drain valve is failed or when the toilet is plugged up according to claim 1, wherein a pressing element abuts against the moving plate in the front, the pressing element pushes the moving plate by a pre-tighten spring, thus making the moving plate closely contacted to the fixed plate.

3. An automatic protect device when the inlet valve or the drain valve is failed or when the toilet is plugged up according to claim 1, wherein the control component further comprises a lever enlarging handle, a crank, a solenoid, a knob and a torsional spring, the lever enlarging handle is eccentric, one end of the lever enlarging handle is disposed with a lock step, while the other end of the lever enlarging handle is disposed with a lock groove to lock to a clip disposed in the crank;

the gear shaft passes through the crank to connect to the knob, the gear shaft, the crank and the knob form a linkage connection, the torsional spring is assembled to the crank and pushes the crank with a torsion force, thus forming a trend to drive the on-off component to close;

when the on-off component is open, the solenoid is locked to the lock step of the lever enlarging handle.

4. An automatic protect device when the inlet valve or the drain valve is failed or when the toilet is plugged up according to claim 3, wherein the housing is disposed with a thumbstall in the position of the solenoid, the thumbstall, when pressed, drives the solenoid to move, so that to manual control the solenoid to release the lever enlarging handle.

5. An automatic protect device when the inlet valve or the drain valve is failed or when the toilet is plugged up according to claim 1, wherein the water level inductor of the water tank comprises a hook, a stand, a slide block, a float, a PCB (Printed Circuit Board) housing and a inductor PCB (Printed Circuit Board) board, the hook is disposed in the stand, the hook hangs in the water tank;

one end of the slide block is fixed to the top end of the PCB housing, the other end is slidably connected to the stand;

the float is slidably connected to the PCB housing, the float is disposed with a magnet.

6. An automatic protect device when the inlet valve or the drain valve is failed or when the toilet is plugged up according to claim 5, wherein a securing layer is filled between the inductor PCB board and the PCB housing.

7. An automatic protect device when the inlet valve or the drain valve is failed or when the toilet is plugged up according to claim 5, wherein the inductor PCB board is disposed with reed switches in different heights according to different water levels, the float is disposed with a magnet, the magnet is cooperated to the reed switches for water level identification.

8. An automatic protect device when the inlet valve or the drain valve is failed or when the toilet is plugged up according to claim 5, wherein the bottom of the PCB housing is disposed with a limit rib, the float moves in the PCB housing between the slide block and the limit rib.

9. An automatic protect device when the inlet valve or the drain valve is failed or when the toilet is plugged up according to claim 1, wherein the water level inductor of the toilet comprises a level switch, a setting rack, a sealing pad, a press board and a lock sleeve, the level switch is assembled to one end of the setting rack, the other end of the setting rack passes through the side wall of the toilet, and locks the sealing pad and then the press board to the toilet by the lock sleeve.

10. An automatic protect device when the inlet valve or the drain valve is failed or when the toilet is plugged up according to claim 9, wherein the level switch comprises a shaft sleeve, a ball float and a limiting piece, the ball float is movably sleeved to the shaft sleeve, the shaft sleeve is disposed with reed switches inside, the ball float is disposed with a magnet;

the limiting piece is assembled to the lower end of the shaft sleeve, the upper end of the shaft sleeve is assembled to the setting rack.

11. An automatic protect device when the inlet valve or the drain valve is failed or when the toilet is plugged up according to claim 1, wherein the water level inductor of the toilet comprises a level switch, a output pipe, a sealing ring and a sealing Oring, the level switch is assembled to the lower end of the output pipe, the output pipe is disposed inside the water tank, the level switch passes through the water tank then into the toilet;

the output pipe is assembled to the bottom of the water tank by a setting holder;

the setting holder is an external threaded pipe with an upper flange in the upper end, the setting holder is fixed to the external wall of the output pipe, the external threaded section of the setting holder inserts into the water tank, and is rotationally connected with a locknut with an external lower flange;

when assembling, rotating the locknut, the upper flange of the setting holder and the lower flange of the locknut screw the bottom wall of the water tank;

the setting holder and the water tank, the locknut and the top surface of the toilet, the setting holder and the output pipe are sealed by sealing rings or sealing O rings;

when the toilet is plugged up and the water level reaches to the induction position of the level switch, the waterway is cut off after a period of time.

12. An automatic protect device when the inlet valve or the drain valve is failed or when the toilet is plugged up according to claim 11, wherein the level switch comprises a shaft sleeve, a ball float and a limiting piece, the ball float is movably sleeved to the shaft sleeve, the shaft sleeve is disposed with reed switches inside, the ball float is disposed with a magnet;

the limiting piece is assembled to the lower end of the shaft sleeve, the upper end of the shaft sleeve is assembled to the setting rack.

13. An automatic protect device when the inlet valve or the drain valve is failed or when the toilet is plugged up according to claim 1, wherein the housing is disposed with a thumbstall in the position of the solenoid, the thumbstall, when pressed, drives the solenoid to move, so that to manual control the solenoid to release the lever enlarging handle.

14. An automatic protect device when an inlet valve or a drain valve is failed or when a toilet is plugged up, wherein the water level inductor of the water tank comprises a hook, a stand, a slide block, a float, a PCB (Printed Circuit Board) housing and a inductor PCB (Printed Circuit Board) board, the hook is disposed in the stand, the hook hangs in the water tank;

one end of the slide block is fixed to the top end of the PCB housing, the other end is slidably connected to the stand;

the float is slidably connected to the PCB housing, the float is disposed with a magnet, comprising an inlet, an outlet, an on-off component, a control circuit, a control component, a water level inductor of the water tank and a water level inductor of the toilet, the water level inductor of the water tank and the water level inductor of the toilet are respectively connected to the control circuit, the control circuit drives the control component, the control component is connected to the on-off component to control the on-off component to open or close, thus implementing the connection or the disconnection of the inlet and the outlet, a main controller comprises the inlet, the outlet, the on-off component, the control circuit and the control component, the main controller is assembled between a water resource pipe and the inlet end of the inlet valve, one side of the stand is disposed with ribs, the other side is disposed with protruding rib, one side on the internal surface of the slide block is disposed with grooves, the grooves are cooperated to the ribs;

the other side of the slide block is disposed with a lock catch, the lock catch is cooperated to the protruding rib, when the lock catch escapes from the protruding rib, the slide block is adjustable, when the lock catch locks to the protruding rib, the slide block keeps still.

* * * * *